US005789907A

United States Patent [19]

Casagrande

[11] Patent Number: 5,789,907

[45] Date of Patent: Aug. 4, 1998

[54] VARIABLE IMPEDENCE TRANSFORMER

[75] Inventor: Serge Casagrande, Lutz, Fla.

[73] Assignee: Top Gulf Coast Corporation, Tampa, Fla.

[21] Appl. No.: 663,479

[22] Filed: Jun. 13, 1996

Related U.S. Application Data

[63] Continuation-in-part of Ser. No. 536,834, Sep. 29, 1995, abandoned, which is a continuation of Ser. No. 384,393, Feb. 3, 1995, abandoned, which is a continuation of Ser. No. 212,288, Mar. 14, 1994, abandoned, which is a continuation of Ser. No. 103,811, Aug. 5, 1993, abandoned, which is a continuation of Ser. No. 972,594, Nov. 6, 1992, abandoned, which is a continuation of Ser. No. 677,768, Mar. 29, 1991, Pat. No. 5,163,173.

[51] Int. Cl.[6] ..... G05F 7/00

[52] U.S. Cl. ..... 323/335; 323/338; 336/73; 336/155

[58] Field of Search ..... 323/329, 332, 323/335, 338; 336/73, 155

[56] References Cited

U.S. PATENT DOCUMENTS

| | | | |
|---|---|---|---|
| 1,910,381 | 5/1933 | Dowling | 336/73 |
| 2,425,622 | 8/1947 | Kronmiller | 336/160 |
| 2,498,475 | 2/1950 | Adams | 323/338 |
| 2,586,657 | 2/1952 | Holt, Jr. | 323/335 |
| 2,792,556 | 5/1957 | Oglebee | 336/155 |
| 2,870,397 | 1/1959 | Kelley, Jr. | 323/335 |
| 3,087,108 | 4/1963 | Toffolo et al. | 323/338 |
| 3,123,764 | 3/1964 | Patton | 323/338 |
| 3,221,280 | 11/1965 | Malsbary et al. | 323/338 |
| 3,343,074 | 9/1967 | Brock | 323/338 |
| 3,426,305 | 2/1969 | Keble | 336/178 |
| 3,437,965 | 4/1969 | Ragsdale | 336/61 |
| 3,505,588 | 4/1970 | Brock | 323/250 |
| 4,019,123 | 4/1977 | Maskery | 336/73 |
| 4,129,820 | 12/1978 | Brock | 323/361 |
| 4,305,056 | 12/1981 | Mochida et al. | 336/178 |
| 4,574,231 | 3/1986 | Owen | 323/253 |
| 4,613,841 | 9/1986 | Roberts | 336/83 |
| 4,956,626 | 9/1990 | Hoppe et al. | 336/60 |
| 5,163,173 | 11/1992 | Casagrande | 323/335 |

FOREIGN PATENT DOCUMENTS

| | | | |
|---|---|---|---|
| 253617 | 4/1967 | German Dem. Rep. . | |
| 2037089 | 7/1980 | United Kingdom | H01F 3/14 |

*Primary Examiner*—Jeffrey L. Sterrett
*Attorney, Agent, or Firm*—Frijouf, Rust & Pyle, PA.

[57] ABSTRACT

An enhanced variable impedance transformer is disclosed for controlling the power from an alternating input power source to a load in accordance with a direct current control signal. The variable impedance transformer comprises a first and a second annular saturable reactor core and an annular power core with a power input winding being simultaneously wound about the annular power core and the first and second annular saturable reactor cores. A power output winding is wound about the annular power core for transferring power to the load. The power input windings are connected to the alternating input power source for establishing a magnetic flux in the annular power core and in the first and second annular saturable reactor cores. A first and a second control winding are respectively wound about the first and second annular saturable reactor cores for controlling saturation of magnetic flux in the first and second annular saturable reactor cores for controlling the power transferred to the power output in accordance with the direct current control signal. The first and second annular saturable cores are disposed in a coaxial relationship with the annular power core being interposed between the first and second annular saturable cores for reducing leakage flux of the variable impedance transformer.

32 Claims, 14 Drawing Sheets

VARIABLE IMPEDENCE TRANSFORMER

CROSS-REFERENCE TO RELATED APPLICATIONS

This is a continuation-in-part of U.S. patent application Ser. No. 08/536,834 filed Sep. 29, 1995, now abandoned. U.S. patent application Ser. No. 08/536,834 filed Sep. 29, 1995 is a continuation of U.S. patent application Ser. No. 08/384,393 filed Feb. 3, 1995, now abandoned. U.S. patent application Ser. No. 08/384,393 filed Feb. 3, 1995 is a continuation of U.S. patent application Ser. No. 08/212,288 filed Mar. 14, 1994, now abandoned. U.S. patent application Ser. No. 08/212,288 filed Mar. 14, 1994, is a continuation of U.S. patent application Ser. No. 08/103,811 filed Aug. 5, 1993, now abandoned. U.S. patent application Ser. No. 08/103,811 filed Aug. 5, 1993, is a continuation of U.S. patent application Ser. No. 07/972,594 filed Nov. 6, 1992, now abandoned. U.S. patent application Ser. No. 07/972,594 filed Nov. 6, 1992, is a continuation of U.S. patent application Ser. No. 07/677,768 filed Mar. 29, 1991, now U.S. Pat. No. 5,163,173. All subject matter set forth in the aforesaid applications are hereby incorporated by reference into the present application as if fully set forth herein.

BACKGROUND OF THE INVENTION

1. Field of the Invention

This invention relates to a variable impedance transformer, and more specifically to an enhanced variable impedance transformer with enhanced performance characteristics.

2. Background of the Invention

Saturable reactors, and more specifically variable impedance transformers provide an extremely rugged, substantially maintenance free means to control large amounts of AC power delivered to large lighting loads, heavy duty electric motors and the like. The high secondary AC power levels are controlled by relatively low DC control power levels wherein the DC control power establishes levels of magnetic flux saturation in appropriate cores proportional to the required AC power output level as is well known to those skilled in the art. Unfortunately, variable impedance transformer is bulky, heavy, and has a relatively slow response time when compared to other power control systems. A final problem encountered with saturable reactors, and more particularly a variable impedance transformer is the alternating voltage induced in the DC control windings by the magnetic flux within the common core having an AC primary winding and a DC control winding.

The induced alternating voltage in the DC control windings places restrictions on the design and operation of the DC control power source. Designers have attempted to solve this deficiency by installing bulky heat sinks with large semiconductors and resistors in parallel with the control windings. Various resistance-capacitance solutions have been described and some designers have attempted to solve this problem by placing a plurality of opposed DC control windings on the control core such that the induced AC voltages cancel each other. In another system, a plurality of AC primary winding/DC control winding common cores are oriented in a manner such that the magnetic flux of a first core flows in opposition to the magnetic flux of a second core proximate the DC control winding thereby having a substantially canceling effect of the magnetic fluxes thereby minimizing the induced AC voltage in the DC control winding.

U.S. Pat. No. 2,498,475 to John Q. Adams teaches a saturable magnetic core with a core construction possessing a characteristic of constant permeability over a specified range of magnetomotive force. Utilizing a two section core assembly with a DC polarizing coil around a first section of the core assembly such that the algebraic sum of the magnetization curves of the polarized and unpolarized core sections is a straight line.

U.S. Pat. No. 2,586,657 to William J. Holt, Jr. teaches a variable voltage transformer for controlling a load voltage by means of an adjustable DC voltage applied to a DC control winding. The device utilizes a plurality of cores with two primary windings, each of the primary windings is simultaneously wound about a secondary core and a saturable core. A secondary winding is wound about each of the secondary cores and the secondary windings are connected in parallel to the load. The DC control winding is wound about both of the saturable cores for controlling the flux level in each of the saturable cores. A flux is induced in each of the saturable cores which are positioned proximate each other by means of an AC voltage applied to the primary windings. The fluxes are opposite and equal to each other, thereby canceling each other and thereby producing substantially zero or little induced AC voltage in the control winding.

U.S. Pat. No. 2,870,397 to Fred W. Kelley, Jr. teaches an improved saturable core apparatus utilizing three cores with two of the cores being saturable by means of a DC control source and the third core acting as a flux conductor for a primary input and secondary output transformer. Two primary windings are wound about the third core in parallel with opposing diodes or rectifiers placed in the path of the primary windings so that the windings only conduct during alternate half cycles of an AC wave.

U.S. Pat. No. 3,087,108 to Domonic S. Toffolo teaches the efficient transfer of power from a source to a load which can operate at 500 degrees Fahrenheit. This device uses a primary, secondary core and a control core, with the primary winding being simultaneously wound about both the primary and secondary cores, the secondary output winding being wound about the secondary core, and the control core about which the control winding is wound. The control winding and control core are at right angles to the primary core with an air gap existing between the control winding core and the solid primary core. In operation the effect of the magnetic flux in the right angle control core produces a saturation in the primary core whereby the AC produced flux flows proportionally through the secondary core, subsequently inducing a voltage in the secondary output winding.

U.S. Pat. No. 3,123,764 to Henry W. Patton teaches the construction of a magnetic amplifier and control device. The signal is impressed on three windings wound about a plurality of cores with the output being taken from two of the cores with a third core being a nonsaturating member for generating a counter electromotive force in the signal input winding to modify the effects of distributive capacitance currents in the amplifier circuit.

U.S. Pat. No. 3,221,280 to James S. Malsbary et al teaches a saturable reactor which does not require divided reactance or control windings to prevent flow of induced AC of the supply frequency in the control winding and is also used in a polyphase system with a minimum number of separate windings. The patent further teaches a three phase system utilizing the loads being in series with the load windings on the cores and each phase of the power supply around which a single control winding surrounds all three phase cores and a fourth core called an auxiliary magnetic core. In a balanced three phase circuit the algebraic sum of the magnetic flux is equal to zero. If the loads become unbalanced, the flux becomes unbalanced which then produces a current in the control windings. The unbalanced flux produces a current in the auxiliary core which opposes and substantially cancels the current in the control core.

U.S. Pat. No. 3,505,588 to Elwood M. Brock teaches a load impedance responsive feedback system for a variable reactance transformer. The variable transformer has three cores, and primary, secondary, control, and feedback windings. A secondary winding and a feedback supply winding are wound on the secondary winding, while the two auxiliary cores carry DC external control and DC feedback control windings. The primary winding is wound around all three cores.

U.S. Pat. No. 3,343,074 to Elwood M. Brock teaches a variable reactance transformer having two saturable cores. The variable reactance transformer has two saturable cores with control windings, a power core with secondary output winding and a primary winding surrounding all three cores and is wound on top the DC and secondary windings. This device uses control windings wound in series opposition thereby creating a bucking current for any induced voltage in the control windings by the primary current flux. Any residual voltage component is dropped across a shunting resistor in parallel with the two control windings.

U.S. Pat. No. 4,129,820 to Elwood M. Brock teaches a variable reactance transformer having a main core and a pair of auxiliary cores whereby the auxiliary cores carry the DC control windings which are divided in that a first winding is wound about the core and a second coil is wound about the first coil and wherein all the control coils are wound in series and in a configuration such that the induced voltages are substantially zero.

U.S. Pat. No. 4,574,231 to Donald W. Owen teaches a magnetic amplifier apparatus for balancing or limiting voltages or currents. The apparatus comprises a first level of magnetic amplifiers which are responsive to a DC control signal. The output of the first level magnetic amplifier provides an input signal for a second level of magnetic amplifiers having gate windings to which the alternating current to be controlled is connected.

Although the above stated devices provide control of AC power by means of a DC control signal, all of the devices suffer from a deficiency in that the devices allow an AC voltage to be induced in the DC control windings.

The adverse effects of the induced AC voltage in DC control windings are well known to those skilled in the art. The AC voltages require added considerations to be made in the design and construction of the DC windings and power supplies. Should the AC voltages exist at substantial levels, the counter EMF developed in the DC windings by the AC voltages could not only prevent saturation of the magnetic core of the saturable reactor but severely damage components in the D.C. control circuit. Winding wire sizes and the number of windings become design constraints, and power supplies require large semiconductors on heat sinks to absorb the effects of the AC voltage, adding to unit weight and cost. Elimination of the induced AC voltage allows greater flexibility in both the saturable reactor and associated power supply designs. When no longer constrained by the induced AC voltage the designer may use as many turns as practical in control windings and size the wire to obtain the resistance required for the correct control current. Although attempts to eliminate the undesirable effects of the induced AC voltage in the DC control windings has met with limited success none of the above stated devices has substantially eliminated the unwanted AC voltage. Non-significant differences or variations in cores and windings are sufficient to produce low levels of induced AC voltages in DC windings.

In my prior U.S. Pat. No. 5,163,173, issued on Nov. 10, 1992, I described a variable impedance transformer that overcame the above described problems of the variable impedance transformers of the prior art. However, in the variable impedance transformer described in my prior U.S. Pat. No. 5,163,173, the output voltage could not be reduced below four percent (4%) of the full output voltage without encountering a considerable increase in cost.

In many application requirements, it is desirable to reduce the output voltage of the variable impedance transformer to less than one percent (1%) of the full load output voltage.

Therefore, it is a primary object of the present invention to provide an enhanced variable impedance transformer with a greater range of control of output voltage than heretofore known in the art.

Another object of the present invention is to provide an enhanced variable impedance transformer capable of reducing the output voltage of the enhanced variable impedance transformer to less than 1% of the full load output voltage.

Another object of the present invention is to provide an enhanced variable impedance transformer incorporating three annular cores that are coaxially arranged relative to one another.

Another object of the present invention is to provide an enhanced variable impedance transformer incorporating three annular gapless cores.

Another object of the present invention is to provide an enhanced variable impedance transformer incorporating three annular cores that wherein each of the annular cores includes a winding thereon.

Another object of the present invention is to provide an enhanced variable impedance transformer wherein the variable impedance transformer is capable of operating with a three phase circuit.

Another object of the present invention is to provide an enhanced variable impedance transformer wherein the variable impedance transformer is capable of operating with a three phase circuit with the primaries of the variable impedance transformer connected in a delta circuit configuration and with the secondaries of the variable impedance transformer providing individual outputs and connected for single phase loads.

Another object of the present invention is to provide an enhanced variable impedance transformer wherein the variable impedance transformer is capable of operating as a three phase to two phase Variable Impedance Transformer as arranged in a Scott configuration or T configuration.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a variable impedance transformer for controlling the power from an alternating input power source to a load in accordance with a direct current control signal. The variable impedance transformer comprises a first and a second annular saturable reactor core and an annular power core. A power input winding is simultaneously wound about the annular power core and the first and second annular saturable reactor cores. A power output winding is wound about the annular power core for transferring power to the load. The power input windings are connected to the alternating input power source for establishing a magnetic flux in the annular power core and in the first and second annular saturable reactor cores. A first and a second control winding are respectively wound about the first and second annular saturable reactor cores for controlling saturation of magnetic flux in the first and second annular saturable reactor cores in accordance with the direct current control signal. The direct current control signal controls the saturation of the magnetic flux in the first and second annular saturable reactor cores thereby controlling the power transferred from the power input winding through the annular power core to the power output. The first and second annular saturable cores are disposed in a coaxial relationship with the annular power core being interposed between the first and second annular saturable cores for reducing leakage flux of the variable impedance transformer.

In a more specific embodiment of the invention, each of the first and second saturable reactor cores and the power core provides a closed loop for the magnetic flux and have a substantially identical cross-sectional area. Preferably, the power core has a cross-sectional area substantially equal to a sum of the cross-sectional areas of the first and second saturable reactor cores.

Each of the first and second saturable reactor cores and the power core is defined by an axial length and a radial thickness defined between an inner and an outer annular diameter. Preferably, the axial length of the power core is equal to the axial lengths of the first and second saturable reactor cores and the radial thicknesses of the first and second saturable reactor cores and the power core is established for enabling the first and second annular cores to be disposed in a coaxial relationship with the annular power core being interposed between the first and second annular saturable cores. In one embodiment of the invention, the radial thickness of the power core is substantially equal to a sum of the radial thicknesses of the first and second saturable reactor cores establishing the power core to have a cross-sectional area substantially equal to a sum of the cross-sectional areas of the first and second saturable reactor cores.

Preferably, the first and second control windings have a substantially identical number of winding turns with the first and second control windings being interconnected in electrical opposition for substantially canceling a resultant magnetic flux induced by the first and second control windings.

An optional low impedance equalizing winding may be wound about the first and second annular saturable reactor cores for shunting any resultant alternating voltage induced by any residual magnetic flux as a result of non-substantial physical variations between the first and second annular saturable reactor cores. The equalizing winding is connected to a low impedance such as a short for shunting any resultant alternating voltage induced within the first and second saturable reactor cores by the first and second control windings. Preferably, each of the first and second control windings has a substantially identical number of turns as the equalizing winding. In one embodiment of the invention, the equalizing winding comprises a first and a second equalizing winding with the first and second equalizing windings being wound about the first and second saturable reactor cores, respectively and being interconnected in electrical opposition.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
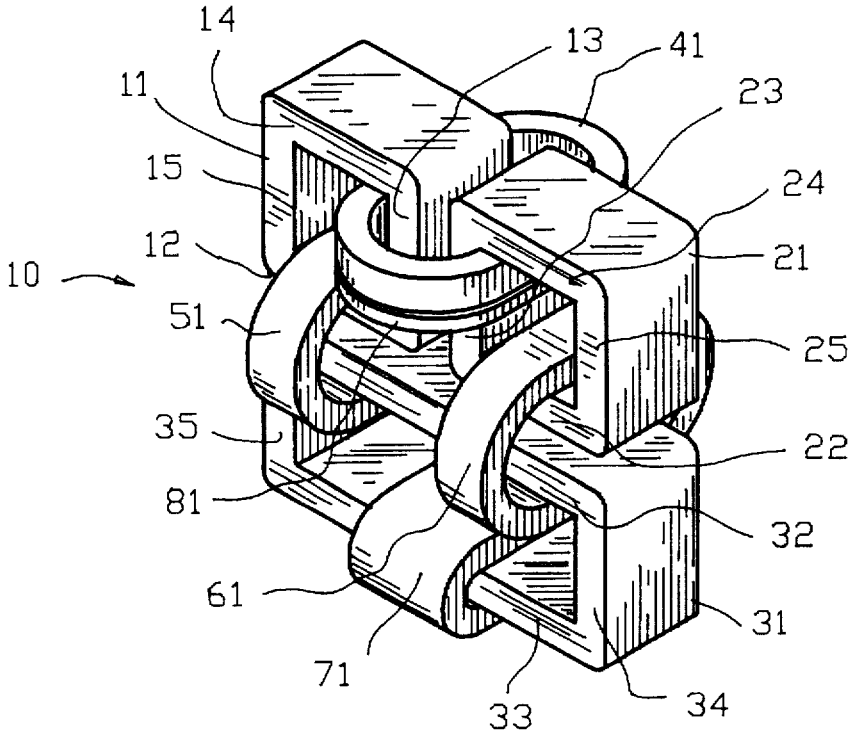
FIG. 1 is an isometric view of a first embodiment of a variable impedance transformer incorporating the present invention.
Figure 2:
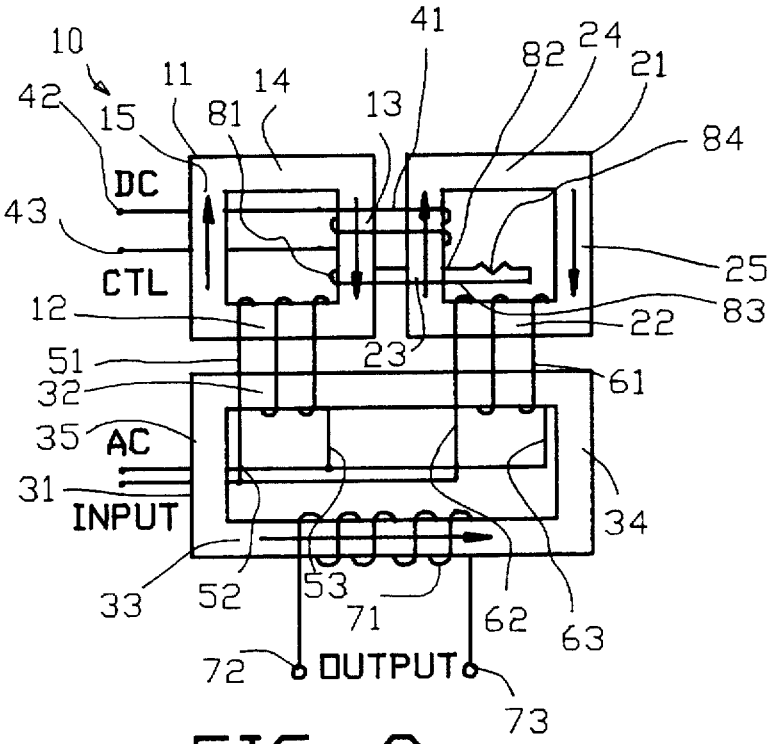
FIG. 2 is a circuit representation of the first embodiment of the variable impedance transformer illustrating the magnetic flux directions during a first half cycle of an alternating current wave.
Figure 3:
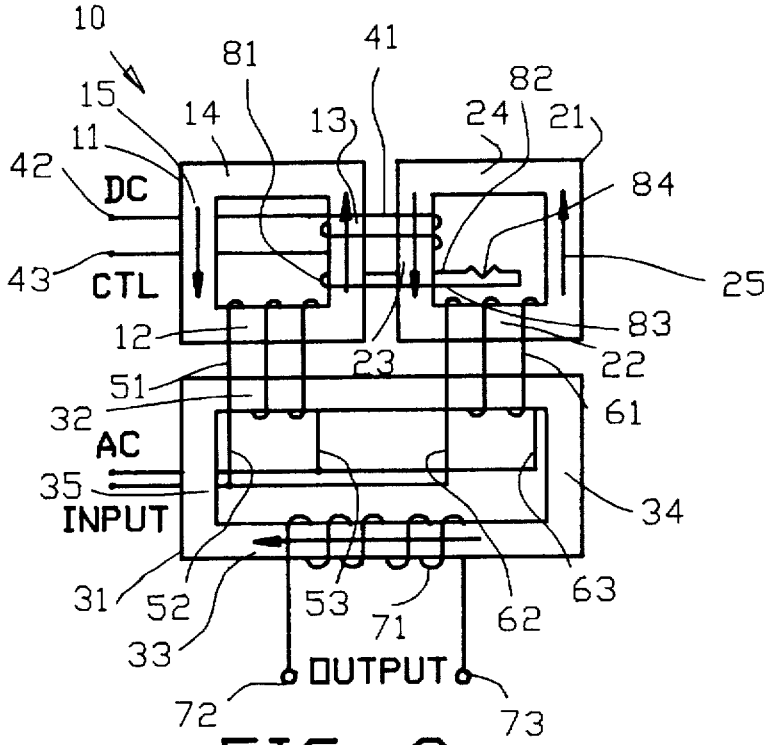
FIG. 3 is a circuit representation of the first embodiment of the variable impedance transformer illustrating the magnetic flux directions during a second half cycle of an alternating current wave.

FIG. 1 is an isometric view of a first embodiment of the present invention illustrating a variable impedance transformer 10. FIG. 2 and FIG. 3 are circuit representations of the first embodiment of the variable impedance transformer 10 illustrating magnetic flux directions during a first half cycle and a second half cycle of an alternating current wave. The variable impedance transformer 10 includes a first and a second saturable reactor core 11 and 21 shown as closed loop square cores with a rectangular cross section. The first saturable reactor core 11 comprises first, second, third and fourth legs 12, 13, 14, and 15 respectively. The second saturable reactor core 21 comprises first, second, third and fourth legs 22, 23, 24, and 25 respectively. A power core 31 has first, second, third and fourth legs 32, 33, 34, and 35. The power core 31 is shown as a rectangular closed loop core with a rectangular cross section.

The saturable reactor cores 11 and 21 and power core 31 are of conventional core construction being fabricated from a plurality of substantially planar lamination comprising a material with a high magnetic permeability including ferromagnetic elements or alloys thereof. For the purposes of illustration variable impedance transformer 10 is shown as an open air cooled assembly, however encapsulation of the variable impedance transformer 10 may be utilized as well as providing a water cooling means (not shown).

Since the variable impedance transformer 10 of the present invention may be designed for operation from less than one hundred volt-amperes to several thousands of volt-amperes in capacity, the input and the output voltages, the frequency of operation, and the current capacity constitute design variable of the variable impedance transformer 10.

A DC control winding 41 having a first end 42 and a second end 43 is wound simultaneously about the second legs 13 and 23 of the first and the second saturable reactor cores 11 and 21. A first power input winding 51 having a first end 52 and a second end 53 is wound simultaneously about the first leg 32 of the power core 31 and the first leg 12 of the first saturable reactor 11. A second power input winding 61 having a first end 62 and a second end 63 is wound simultaneously about the first leg 32 of the power core 31 and the first leg 22 of the second saturable reactor 21. A power output winding 71 having a first end 72 and a second end 73 is wound about the second leg 33 of the power core 31.

The variable impedance transformer 10 as heretofore described is a conventional variable impedance transformer as should be well known to those skilled in the art. In accordance with the prior art practice, a substantial effort is made to construct the first and second saturable reactor cores 11 and 21 to be identical to one another to produce the same resultant magnetic flux from the first and the second power input windings 51 and 61. In addition, the first and second saturable reactor cores 11 and 21 are established relative to one another such that magnetic flux in the second leg 13 of the first saturable reactor core 11 opposes or cancels the magnetic flux in the second leg 23 of the second saturable reactor core 21. These prior art construction techniques sought to eliminate an AC voltage from being induced into the control winding 41. Since it is difficult to construct the first and second saturable reactor cores 11 and 21 in an identical manner, and for numerous other reasons, the prior art technique has only reduced the level of the AC voltage in the control winding 41.

To overcome this problem, the present invention incorporates an equalizing winding 81 having a first end 82 and a second end 83. The equalizing winding 81 is wound simultaneously about the second legs 13 and 23 of the first and the second saturable reactor cores 11 and 21. The first and second ends 82 and 83 of the equalizing winding 81 are either shorted or are connected to a low impedance 84. Preferably, the number of turns in the equalizing winding 81 is substantially less than the number of turns in the DC control winding 41. As will be described in greater detail hereinafter, the equalizing winding 81 solves the problems encountered by the prior art.

In accordance with the prior art practice, a wide variety of conductor dimensions may be utilized in construction of the variable impedance transformer 10 including the DC control winding 41, the equalizing winding 81, the first and second power input windings 51 and 61 and the power output winding 71. The conductor dimensions include the number of turns per winding and the winding cross-section. The winding cross-section may vary from fine insulated round, square to rectangular wire or insulated foil to metallic tubing as should be well known to those skilled in the art.

Figure 4:
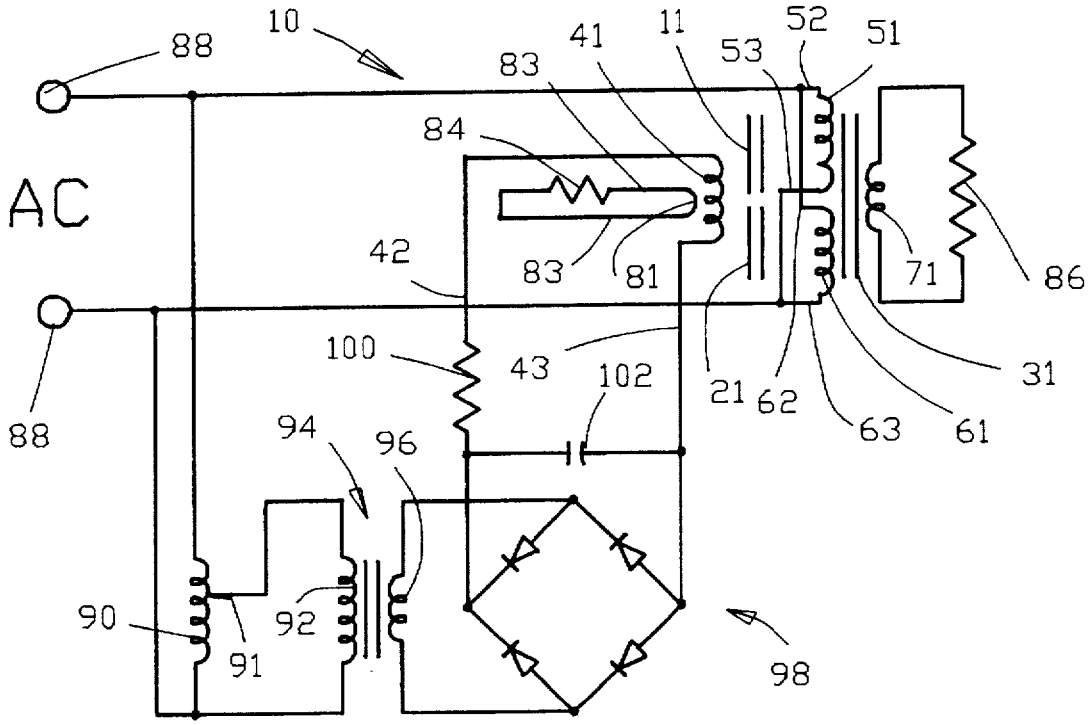
FIG. 4 is an schematic diagram of the first embodiment of the present invention shown in FIGS. 1–3 connected to an alternating current source.

FIG. 4 is a schematic diagram of the variable impedance transformer 10 of FIGS. 1–3 connected to an alternating current power supply 88. The schematic diagram of FIG. 4 is a simplified method for manually controlling the power to the load 86 from the variable impedance transformer 10. It should be appreciated by those skilled in the art that the schematic diagram of FIG. 4 is not to be interpreted as the normal method of controlling the output power of the variable impedance transformer 10. Typically, the variable impedance transformer 10 is controlled by feedback circuits, computers or the like for maintaining the power to the load 86 at a desired level.

The alternating current power supply 88 is connected to the first and second ends 52 and 53 of the first power input winding 51 and is connected to the first and second ends 62 and 63 of the second power input winding 61.

The first and second ends 72 and 73 of the power output winding 71 are connected to a load 86. The load 86 may be a furnace or lighting equipment or the like typically having a substantial operating current requirement with a significantly higher surge current required during the start of the circuit.

The alternating current power supply 88 is connected to a variable auto transformer 90 having a variable voltage tap 91 with the variable voltage tap 91 being connected to an input winding 92 of a voltage reduction transformer 94. An output winding 96 of the voltage reduction transformer 94 is connected to a DC bridge 98 for supplying a variable DC voltage to the first and second ends 42 and 43 of the control winding 41. A resistor 100 functions to limit the current through the control winding 41 whereas a capacitor 102 functions as a filter.

The variable impedance transformer 10 of the present invention operates in a manner similar to a conventional variable impedance transformer. The variable voltage tap 91 of the voltage reduction transformer 94 is positioned to supply a minimum DC voltage to the control winding 41. When the AC power supply 88 is activated, an alternating current flows through the first and the second power input windings 51 and 61 to establish a magnetic flux flow in the power core 31. In addition, alternating current flow through the first and the second power input windings 51 and 61 establishes a magnetic flux flow in the first and second saturable reactor cores 11 and 21.

Since the magnetic flux established by the current flow through the first and second input windings 51 and 61 is divided between the power core 31 and the first and second saturable reactor cores 11 and 21, the power transferred through the power core 31 and the output winding 71 to the load 86 is substantially reduced. The amount of the power reduction is dependent upon construction parameters including winding turns and core construction between the power core 31 and the first and second saturable reactor cores 11 and 21. The reduction of power transferred through the power core 31 and the output winding 71 to the load 86 compensates for the significantly higher surge current required during the start of the load 86.

As the variable voltage tap 91 of transformer 94 is positioned to supply a DC voltage to the control winding 41, an additional magnetic flux is established in the first and second saturable reactor cores 11 and 21. The additional magnetic flux established in the first and second saturable reactor cores 11 and 21 results in an increase in the level of magnetic flux flow in the power core 31 and an increase in the power transferred through the power core 31 and the output winding 71 to the load 86.

As the variable voltage tap 91 of transformer 94 is positioned to supply additional DC voltage to the control winding 41, the magnetic flux in the first and second saturable reactor cores 11 and 21 reaches magnetic flux saturation. When the magnetic flux in the first and second saturable reactor cores 11 and 21 reaches a saturation level, substantially all the magnetic flux flow established by the first and second power input windings 51 and 61 is established in the power core 31. Accordingly, substantially all of the power from the first and second power input windings 51 and 61 is transferred through the power core 31 and the output winding 71 to the load 86.

If the first and second ends 72 and 73 of the power output winding 71 of the variable impedance transformer 10 are connected to a load 86 such a furnace or lighting equipment or the like typically having a substantial operating current, the variable voltage tap 91 of the voltage reduction transformer 94 is positioned to supply a minimum DC voltage to the control winding 41. When the AC power supply 88 is activated, the high impedance provided by the first and second saturable reactor cores 11 and 21 limit the current from the output winding 71 to the load 86.

Some variable impedance transformers of the prior art have utilized the aforementioned method to cancel an induced voltage in control winding 41. However, since precisely identical winding placement combined with identical core characteristics are substantially impossible to achieve in production, non-significant differences or variations in the cores and in the windings are sufficient to produce varying levels of induced AC voltages in the DC control windings 41.

The variable impedance transformer 10 of the present invention utilizes the equalizing winding 81 wound about the second legs 13 and 23 of the first and second saturable reactor cores 11 and 21. Preferably, the number of windings in the equalizing winding 81 is substantially less than the number of windings in the DC control winding 41. The first and second ends 82 and 83 of the equalizing winding 81 may be directly connected to one another forming a completed electrical circuit or may be connected to a low impedance 84. The AC voltage induced as a result of non-significant differences or variations in the cores and in the windings is preferentially shunt dissipated by the equalizing winding 81 relative to the DC control winding 41. The AC voltage is preferentially shunt dissipated by the equalizing winding 81 relative to the DC control winding 41 since the equalizing winding 81 is selected to have a significantly lower impedance relative to the control winding 41. Since the AC circulating currents produced by induced AC voltages are established within the equalizing winding 81, there is a substantial reduction in the AC voltage induced in the control winding 41. The value of the low impedance 84 may be adjusted to reduce the circulating currents to acceptable levels.

Figure 5:
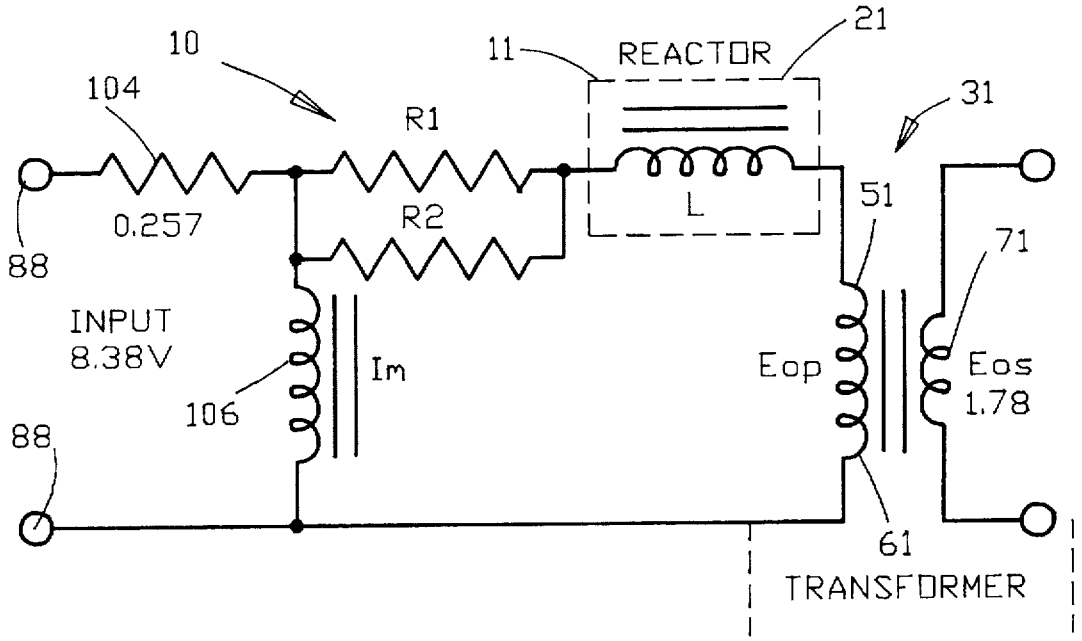
FIG. 5 is an equivalent circuit diagram of the circuit of FIG. 4.

FIG. 5 is a substantially simplified equivalent circuit of the variable impedance transformer 10. The variable impedance transformer 10 is normally designed so that the impedance of the first and second saturable reactor cores 11 and 21 is equal to the impedance of the power core 31. Therefore, one-half of the input voltage 88 appears across the first and second saturable reactor cores 11 and 21 and one-half of the input voltage 88 would appear across the power core 31.

When the load 86 is connected to the output winding 71, the reflected impedance to the power core 31 is many times less than the impedance of the first and second saturable reactor cores 11 and 21. The voltage across the input windings 51 and 61 of power core 31 is substantially the ratio of the input impedance of the power core 31 to the impedance of the first and second saturable reactor cores 11 and 21 times the input voltage 88. Accordingly, with no D.C. current flowing into the control windings 41, the output power to load 86 is normally less than five percent (5%) of the capacity of the variable impedance transformer 10. As D.C. current flows into the control winding 41, the impedance of the first and second saturable reactor cores 11 and 21 drops allowing more voltage to appear across the input windings 51 and 61 of power core 31. The voltage across the input windings 51 and 61 of power core 31 progressively increases as more D.C. current flows into the control winding 41 until saturation of the first and second saturable reactor cores 11 and 21 is achieved. At saturation, the first and second saturable reactor cores 11 and 21 become essentially resistive and substantially all of the input voltage 88 appears across the input windings 51 and 61 of the power core 31.

The equivalent circuit is based on a test transformer employing three Arnold AH320 cores. The specifications of each of the cores was D=2; E=1; F=1.625 and G=4.5 and weighing 7.33 pounds. An input load resistor 104 was connected for measuring the current through the variable impedance transformer 10. Resistors R1 and R2 represent the equivalent resistance of the first and second power input windings 51 and 61 whereas the inductance 106 is the equivalent magnetizing core winding of the first and second power input windings 51 and 61. Since the magnetic flux established by the current flow through the first and second input windings 51 and 61 is divided between the power core 31 and the first and second saturable reactor cores 11 and 21 as set forth above, the first and second saturable reactor cores 11 and 21 appear in series with the first and second input windings 51 and 61 in the equivalent circuit of FIG. 5.

When a voltage of 8.38 volts was applied through the input load resistor 104 of 0.257 ohms, a voltage of 0.611 volts was measured across the input load resistor 104 ohms indicating that 2.38 amperes of current was flowing through the first and second input windings 51 and 61. The test transformer produced an open circuit voltage of 1.78 volts on the output winding 71.

Figure 6:
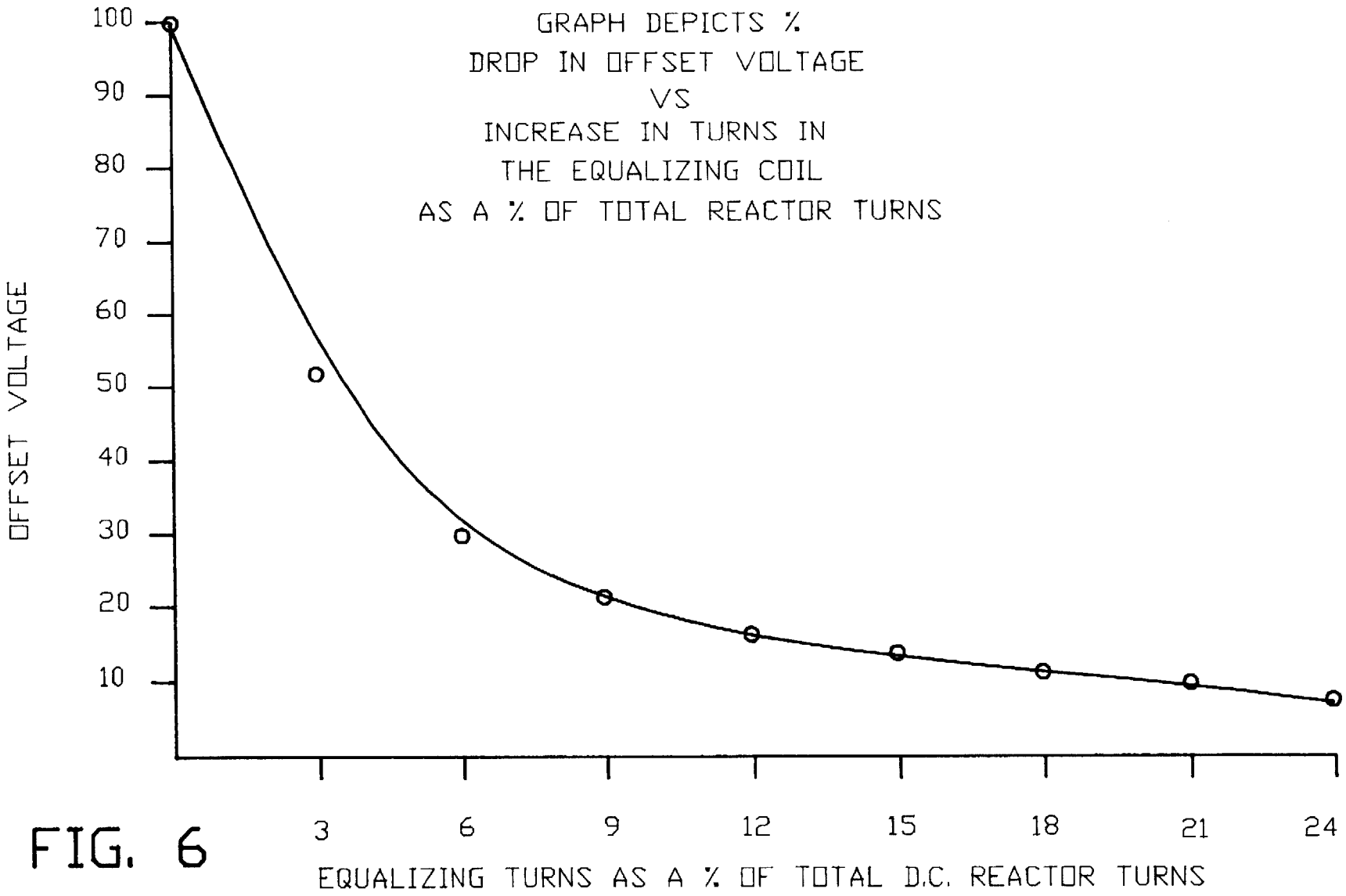
FIG. 6 is a graph of an offset voltage as a function of the number of turns of the equalizing winding.

FIG. 6 is a graph of an offset voltage (induced AC voltage) as a function of the number of turns of the equalizing winding 81. The abscissa of the graph plots the total number of turns of the equalizing winding 81 as a percentage of total number of turns of the control winding 41. The ordinate of the graph plots the percentage of offset voltage (induced AC voltage). With a zero turn equalizing winding 81, or the absence of the equalizing winding 81, the offset voltage is one hundred percent (100%) for the tested variable impedance transformer 10. With the introduction of an equalizing winding 81 having only three percent (3%) of total number of turns of the control winding 41, the offset voltage (induced AC voltage) is reduced by almost fifty percent (50%). When the number of turns of the equalizing winding 81 is increased to twelve percent (12%) of total number of turns of the control winding 41, the offset voltage (induced AC voltage) is reduced below twenty percent (20%). When the number of turns of the equalizing winding 81 is increased to twenty-four percent (24%) of total number of turns of the control winding 41, the offset voltage (induced AC voltage) is reduced below ten percent (10%). Accordingly, an equalizing winding having a small number of turns relative to the total number of turns of the control winding 41 provides a substantial reduction in the offset voltage (induced AC voltage).

The present invention may be incorporated into a variable impedance transformer of various designs and configurations as illustrated by the second and third embodiments shown in FIGS. 7–12. In addition, the equalizing winding 81 may be incorporated into a variable impedance transformer in various configurations as illustrated by the fourth embodiments shown in FIGS. 13–14.

Figure 7:
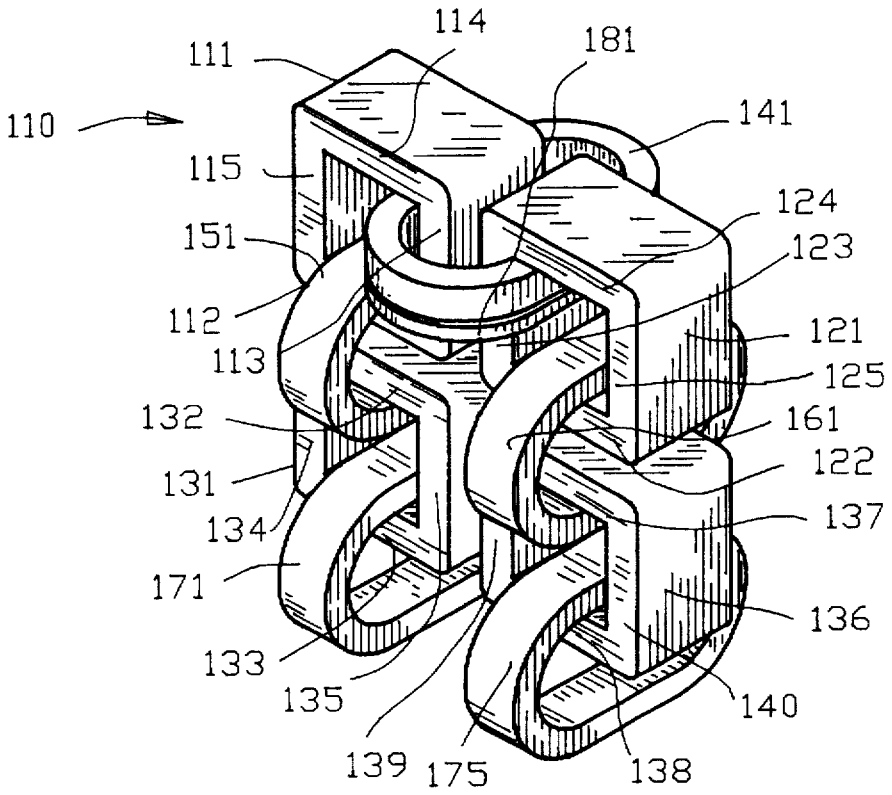
FIG. 7 is an isometric view of a second embodiment of a variable impedance transformer incorporating the present invention.
Figure 8:
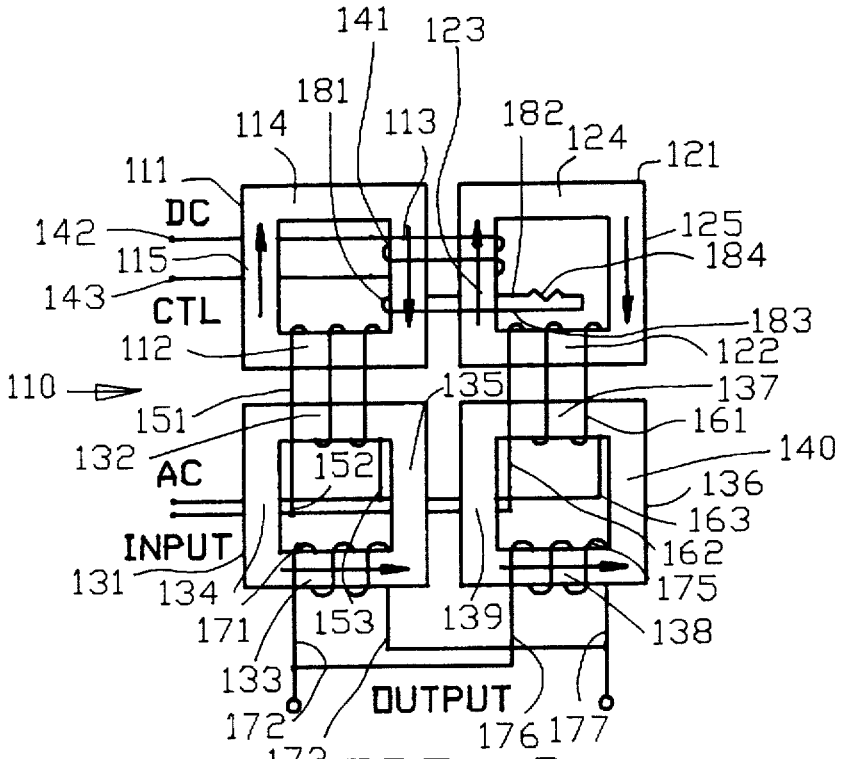
FIG. 8 is a circuit representation of the second embodiment of the variable impedance transformer illustrating the magnetic flux directions during a first half cycle of an alternating current wave.
Figure 9:
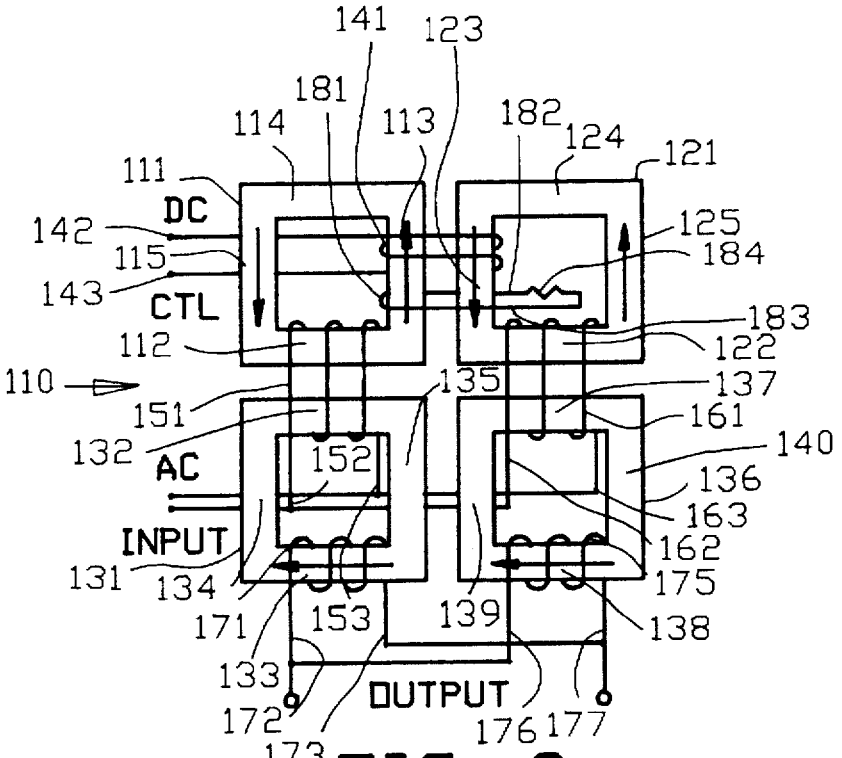
FIG. 9 is a circuit representation of the second embodiment of the variable impedance transformer illustrating the magnetic flux directions during a second half cycle of an alternating current wave.

FIG. 7 is an isometric view of a second embodiment of the present invention illustrating a variable impedance transformer 110 having a different configuration than the first embodiment shown in FIGS. 1–3. FIG. 8 and FIG. 9 are circuit representations of the second embodiment of the variable impedance transformer 110 illustrating magnetic flux directions during a first half cycle and a second half cycle of an alternating current wave. The variable impedance transformer 110 includes a first and a second saturable reactor core 111 and 121. The first saturable reactor core 111 comprises first, second, third, and fourth legs 112, 113, 114, and 115 respectively whereas the second saturable reactor core 121 comprises first, second, third and fourth legs 122, 123, 124, and 125 respectively.

In this embodiment, the power core comprises a first power core 131 having first, second, third and fourth legs 132, 133, 134, and 135 respectively, and a second power core 136 having first, second, third and fourth legs 137, 138, 139, and 140 respectively. A DC control winding 141 having a first end 142 and a second end 143 is wound simultaneously about the second legs 113 and 123 of the first and the second saturable reactor cores 111 and 121 respectively. A first power input winding 151 having a first end 152 and a second end 153 is wound simultaneously about the first leg 132 of the first power core 131 and the first leg 112 of the first saturable reactor core 111. A second power input winding 161 having a first end 162 and a second end 163 is wound simultaneously about the first leg 137 of the second power core 136 and the first leg 122 of the second saturable reactor core 121. A first power output winding 171 having a first end 172 and a second end 173 is wound about the second leg 133 of the first power core 131 whereas a second power output winding 175 having a first end 176 and a second end 177 is wound about the second leg 138 of the second power core 136. An equalizing winding 181 having a first end 182 and a second end 183 is wound simultaneously about the second legs 113 and 123 of the first and the second saturable reactor cores 111 and 121 respectively. The first and second ends 182 and 183 of the equalizing winding 181 are connected to the low impedance 184.

The variable impedance transformer 110 of the second embodiment of the invention shown in FIGS. 7–9 operates in a manner similar to the operation of the variable impedance transformer 10 of the first embodiment of the invention shown in FIGS. 1–3.

The AC voltage induced as a result of non-significant differences or variations in the cores and the windings is preferentially shunt dissipated by the equalizing winding 181 relative to the DC control winding 141 providing a substantial reduction in the AC voltage induced in the control winding 41.

Figure 10:
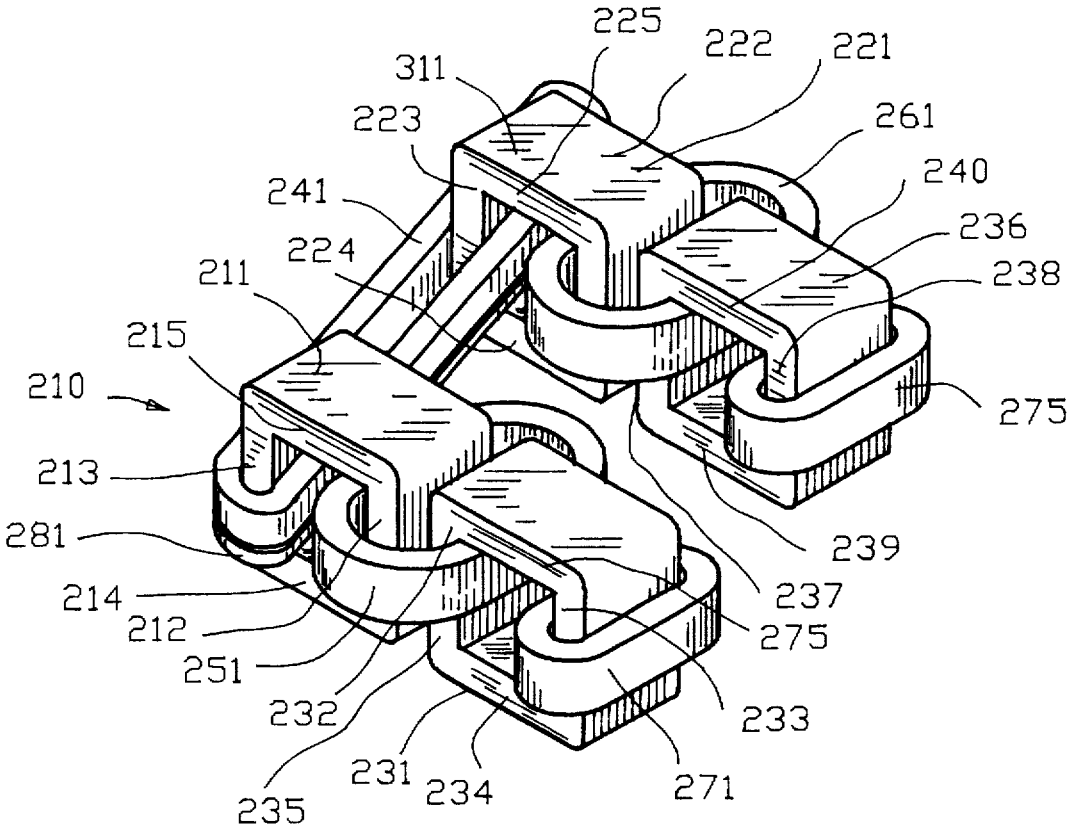
FIG. 10 is an isometric view of a third embodiment of a variable impedance transformer incorporating the present invention.
Figure 11:
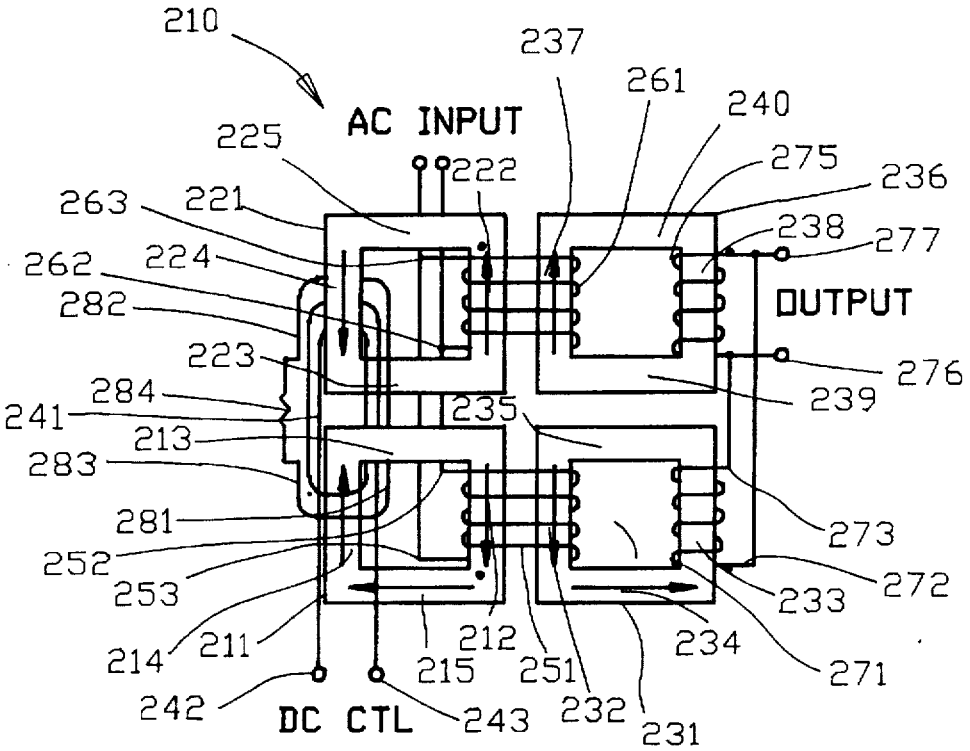
FIG. 11 is a circuit representation of the third embodiment of the variable impedance transformer illustrating the magnetic flux directions during a first half cycle of an alternating current wave.
Figure 12:
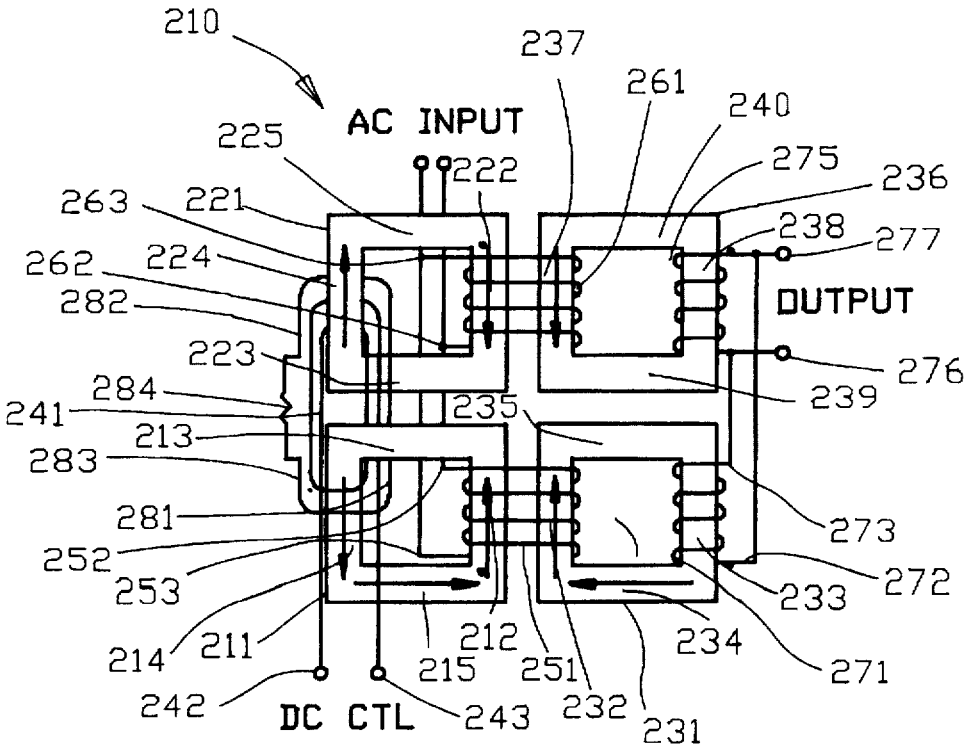
FIG. 12 is a circuit representation of the third embodiment of the variable impedance transformer illustrating the magnetic flux directions during a second half cycle of an alternating current wave.

FIG. 10 is an isometric view of a third embodiment of the present invention illustrating a variable impedance transformer 210 having still a different configuration than the first and second embodiment shown in FIGS. 1–3 and 7–9. FIG. 11 and FIG. 12 are circuit representations of the third embodiment of the variable impedance transformer 210 illustrating magnetic flux directions during a first half cycle and a second half cycle of an alternating current wave. The variable impedance transformer 210 includes a first and a second saturable reactor core 211 and 221. The first saturable reactor core 211 comprises first, second, third, and fourth legs 212, 213, 214, and 215 respectively, whereas the second saturable reactor core 221 comprises first, second, third, and fourth legs 222, 223, 224, and 225 respectively.

A first power core 231 includes a first, second, third and fourth legs 232, 233, 234, and 235 respectively, whereas a second power core 236 includes a first, second, third and fourth legs 237, 238, 239, and 240 respectively. A DC control winding 241 having a first end 242 and a second end 243 is wound simultaneously about the second legs 213 and 223 of the first and the second saturable reactor cores 211 and 221 respectively. A first power input winding 251 having a first end 252 and a second end 253 is wound simultaneously about the first leg 232 of the first power core 231 and the first leg 212 of the first saturable reactor core 211. A second power input winding 261 having a first end 262 and a second end 263 is wound simultaneously about the first leg 237 of the second power core 236 and the first leg 222 of the second saturable reactor core 221. A first power output winding 271 having a first end 272 and a second end 273 is wound about the second leg 233 of the first power core 231 whereas a second power output winding 275 having a first end 276 and a second end 277 is wound about the second leg 238 of the second power core 236.

An equalizing winding 281 having a first end 282 and a second end 283 is wound simultaneously about the second legs 213 and 223 of the first and the second saturable reactor cores 211 and 221 respectively, with the first and second ends 282 and 283 being connected to the low impedance 284.

The variable impedance transformer 210 of the third embodiment of the invention shown in FIGS. 10–12 operates in a manner similar to the operation of the variable impedance transformers 10 and 110 of the first and second embodiments shown in FIGS. 1–3 and 7–9. The AC voltage induced by non-significant variations in the cores and the windings is preferentially shunt dissipated by the equalizing winding 281 providing a substantial reduction in the AC voltage induced in the control winding 241.

The variable impedance transformer 210 of FIGS. 10–12 operates in a manner similar to the variable impedance transformer 110 of FIGS. 7–9. In contrast to the variable impedance transformer 110 of FIGS. 7–9, the magnetic flux in the first power core 231 and the first saturable reactor core 211 flows in an opposite direction relative to the magnetic flux in the second power core 236 and the second saturable reactor core 221 in the variable impedance transformer 210 of FIGS. 10–12. The opposite magnetic flux in the first and second power cores 231 and 236 and in the first and second saturable reactor cores 211 and 236 is the result of the first power input winding 251 being wound in a direction opposite to the second power input winding 261.

The first embodiment of the variable impedance transformer 10 shown in FIGS. 1–3 has several advantages over the second embodiment of the variable impedance transformer 110 shown in FIGS. 7–9 and the third embodiment of the variable impedance transformer 210 shown in FIGS. 10–12. The first embodiment of the variable impedance transformer 10 shown in FIGS. 1–3 only requires a single power core 31 and first and second saturable reactor cores 11 and 21 in contrast to the plural power core 131 and 140 of FIGS. 7–9 and the plural power core 231 and 240 of FIGS. 10–12. Accordingly, the first embodiment of the variable impedance transformer 10 of FIGS. 1–3 has a reduced weight of approximately sixty-seven percent (67%) over the second and third embodiments of the variable impedance transformer 110 and 210.

The second and third embodiments of the variable impedance transformer 110 and 210 of FIGS. 7–9 and FIGS. 10–12 have an advantage over the first embodiment of the variable impedance transformer 10 shown in FIGS. 1–3 since the output windings 171 and 175 of FIGS. 7–9 and the output windings 271 and 275 of FIGS. 10–12 can easily be wound inside the input windings 151 and 161 of FIGS. 7–9 and the input windings 251 and 261 of FIGS. 10–12 to provide a superior coupling between the input windings and the output windings.

Figure 13:
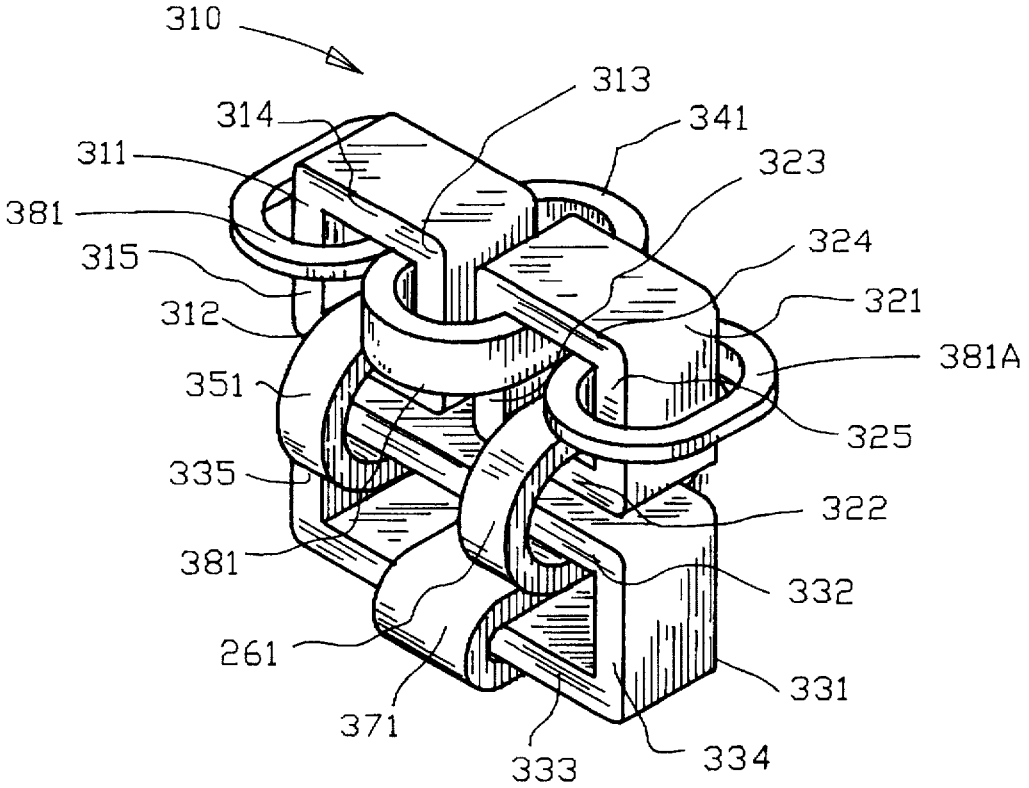
FIG. 13 is an isometric view of a fourth embodiment of a variable impedance transformer incorporating the present invention.
Figure 14:
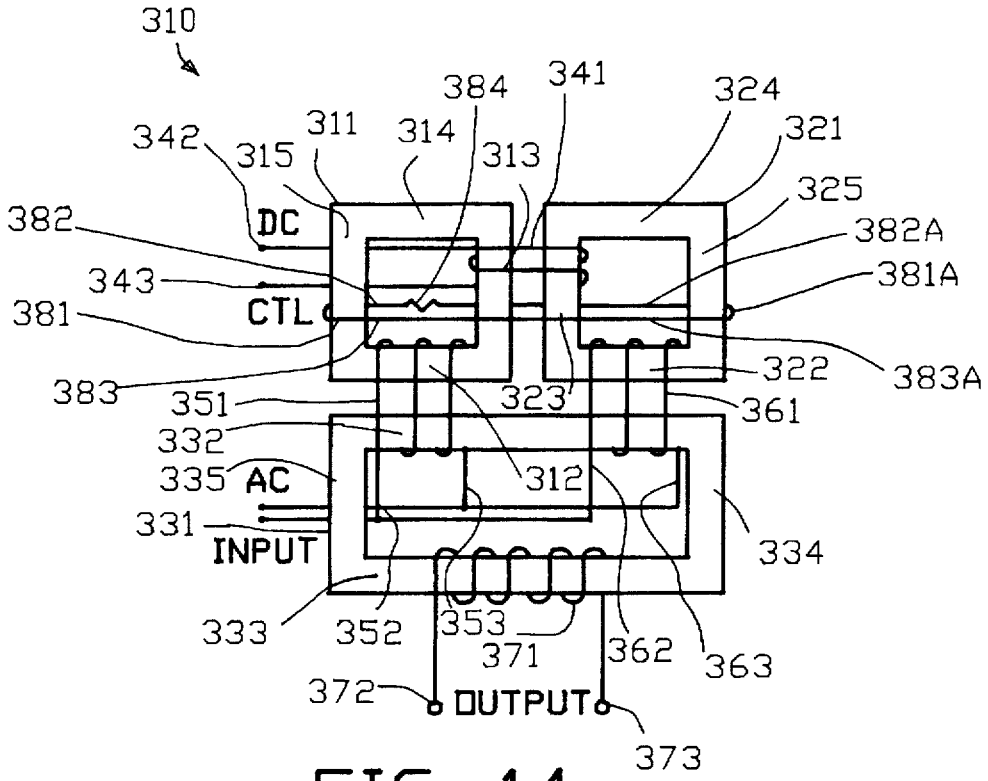
FIG. 14 is a circuit representation of the fourth embodiment of the variable impedance transformer.

FIG. 13 is an isometric view of a fourth embodiment of the present invention illustrating a variable impedance transformer 310 with FIG. 14 being a circuit representation thereof. The variable impedance transformer 310 is similar to the first embodiment shown in FIGS. 1–3 and includes a first and a second saturable reactor core 311 and 321. The first saturable reactor core 311 comprises a first, second, third and fourth legs 312, 313, 314, and 315 respectively. The second saturable reactor core 321 comprises a first, second, third and fourth legs 322, 323, 324, and 325 respectively. A power core 331 has first, second, third and fourth legs 332, 333, 334, and 335.

A DC control winding 341 having first and second ends 342 and 343 is wound simultaneously about the second legs 313 and 323 of the first and the second saturable reactor cores 311 and 321. A first power input winding 351 having first and second ends 352 and 353 is wound simultaneously about the first leg 332 of the power core 331 and the first leg 312 of the first saturable reactor core 311. A second power input winding 361 having first and second ends 362 and 363 is wound simultaneously about the first leg 332 of the power core 331 and the first leg 322 of the second saturable reactor core 321. A power output winding 371 having first and second ends 372 and 373 is wound about the second leg 333 of the power core 331.

In this embodiment, the variable impedance transformer 310 comprises a first and a second equalizing winding 381 and 381A. The first and second equalizing windings 381 and 381A are independently wound about the fourth legs 315 and 325 of the first and the second saturable reactor cores 311 and 321. The first equalizing winding 381 includes first and second ends 382 and 383 whereas the second equalizing winding 381A includes first and second ends 382A and 383A. The first equalizing winding 381 is wound in opposition to the second equalizing winding 381A with a low impedance 384 interconnection the first ends 382 and 382A of the first and second equalizing windings 381 and 381A. The second ends 383 and 383A of the first and second equalizing windings 381 and 381A are directly interconnected.

In a manner similar to the equalizing winding 81 of FIGS. 1–3, the first and second equalizing windings 381 and 381A preferentially shunt dissipate from the DC control winding 341, the AC voltage induced as a result of non-significant differences or variations in the cores and the windings. More specifically, any difference of voltage induced within the first and second equalizing windings 381 and 381A will cancel with one another to produce a resultant voltage within one of the first and second equalizing windings 381 and 381A. The resultant voltage within the one of the first and second equalizing windings 381 and 381A will induce a magnetic flux in opposition to the original AC flux developed as a result of non-significant differences or variations in the cores and the windings. Preferably, the first and second equalizing windings 381 and 381A are selected to have a significantly lower impedance relative to the control winding 341.

It should be appreciated by those skilled in the art that a single or multiple equalizing windings may be utilized in any of the embodiments set forth herein. In addition, the use of equalizing windings may be applied to variable impedance transformers of various designs and constructions as well as auto transformers and the like. It should also be appreciated by those skilled in the art that the principals set forth herein are equally applicable to either single phase or three phase operation.

Although the saturable reactor cores are illustrated as employing substantially square closed loop cores with rectangular cross-sections and the power core is illustrated as employing a rectangular closed loop core with a rectangular cross-section, it should be understood that other core configurations may be utilized within the scope of the present invention. In addition to square and rectangular cores, oval cores, torroidal cores, "C" cores, and distributed air gap cores may be used with equal success. The utilization of "C" cores provides a simple core winding process prior to the joining of two "C" core assemblies. Distributed air gap cores provide the same ease of winding, but provide a more uniform magnetic flux flow around the closed loop core, since the air gap spaces are distributed about the closed loop. Core cross-sections may likewise include square, rectangular and crucifix cross-sections as is well known to those skilled in the art.

Figure 15:
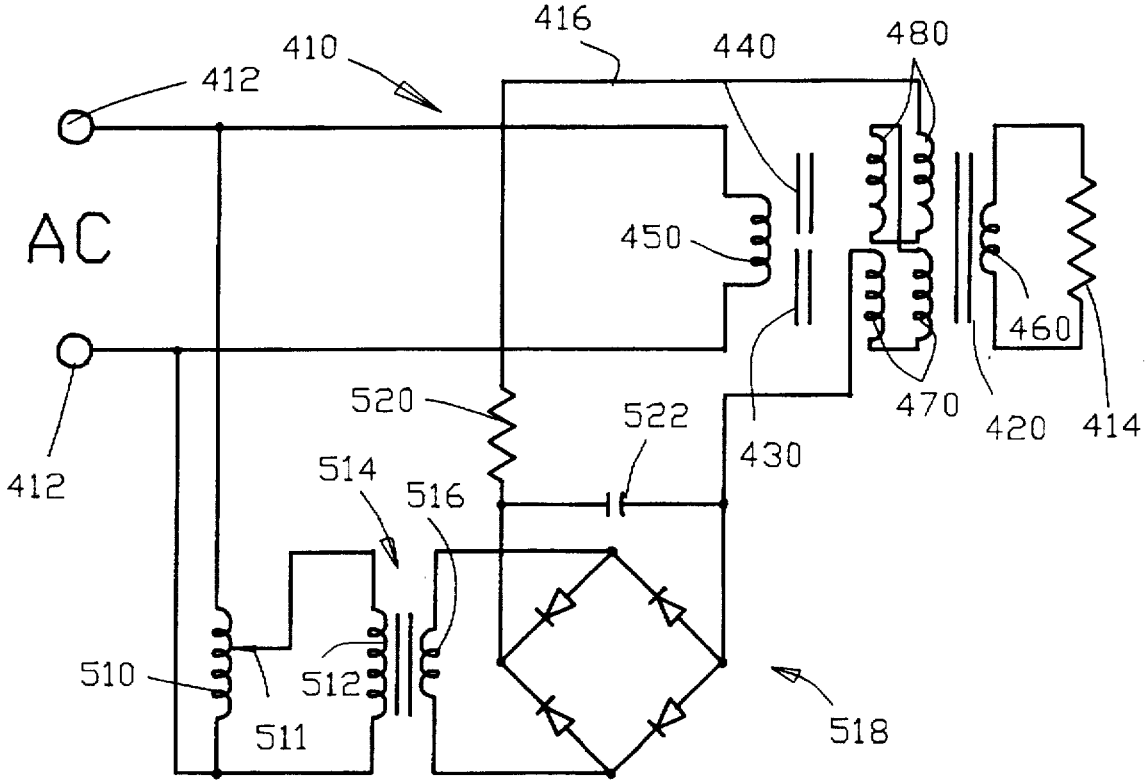
FIG. 15 is a circuit diagram of a fifth embodiment of a variable impedance transformer connected to an alternating input power source.

FIG. 15 is a circuit diagram of the variable impedance transformer 410 for controlling electric power from an alternating input power source 412 to a load 414 in accordance with a direct current control signal 416. The load 414 may be a furnace or lighting equipment or the like typically having a substantial operating current requirement with a significantly higher surge current required during the start of the circuit.

The variable impedance transformer 410 comprises a power core 420 and a first and a second saturable cores 430 and 440. A power input winding 450 is simultaneously wound about the power core 420 and wound about the first and second saturable cores 430 and 440 and is connected to the alternating input power source 412. A power output winding 460 is wound about the power core 420 for transferring power to the load 414.

A first and a second control winding 470 and 480 are respectively wound about the first and second annular saturable reactor cores 430 and 440 for controlling saturation of magnetic flux in said first and second annular saturable reactor cores 430 and 440 in accordance with the direct current control signal 416. The direct current control signal 416 controls the saturation of the magnetic flux in the first and second saturable reactor cores 430 and 440 thereby controlling the power transferred from the power input winding 450 through the power core 420 to the power output winding 460.

The direct current control signal 416 is generated by a variable auto transformer 510 connected across the alternating input power source 412. The variable auto transformer 510 has a variable voltage tap 511 with the variable voltage tap 511 being connected to an input winding 512 of a voltage reduction transformer 514. An output winding 516 of the voltage reduction transformer 514 is connected to a DC bridge 518 for supplying a variable DC voltage to the first and second control windings 470 and 480. A resistor 520 functions to limit the current through the first and second control windings 470 and 480 whereas a capacitor 522 functions as a filter.

It should be appreciated by those skilled in the art that the circuit diagram of FIG. 15 is not to be interpreted as the normal method of controlling the output power of the variable impedance transformer 410. Typically, the variable impedance transformer 410 is controlled by feedback circuits, computers or the like for maintaining the power to the load 414 at a desired level.

The variable impedance transformer 410 of FIG. 15 operates in a manner similar to a conventional variable impedance transformer. The variable voltage tap 511 of the voltage reduction transformer 514 is positioned to supply a minimum DC voltage to the control windings 470 and 480. When the alternating input power source 412 is activated, an alternating current flows through the power input windings 450 to establish a magnetic flux flow in the power core 420. In addition, alternating current flow through the power input winding 450 establishes a magnetic flux flow in the first and second saturable reactor cores 430 and 440.

Since the magnetic flux established by the current flow through the power input winding 450 is divided between the power core 420 and the first and second saturable reactor cores 430 and 440, the power transferred through the power core 420 and the power output winding 460 to the load 414 is substantially reduced.

As the variable voltage tap 511 of transformer 510 is positioned to supply a DC voltage to the first and second control windings 470 and 480, an additional magnetic flux is established in the first and second saturable reactor cores 430 and 440. The additional magnetic flux established in the first and second saturable reactor cores 430 and 440 results in an increase in the level of magnetic flux flow in the power core 420 and an increase in the power transferred through the power core 420 and the power output winding 460 to the load 414.

As the variable voltage tap 511 of transformer 510 is positioned to supply additional DC voltage to the first and second control winding 470 and 480, the magnetic flux in the first and second saturable reactor cores 430 and 440 reaches magnetic flux saturation. When the magnetic flux in the first and second saturable reactor cores 430 and 440 reaches a saturation level, substantially all the magnetic flux flow established by the power input winding 450 is established in the power core 420. Accordingly, substantially all of the power from the power input windings 450 is transferred through the power core 420 and the power output winding 460 to the load 414.

Figure 16:
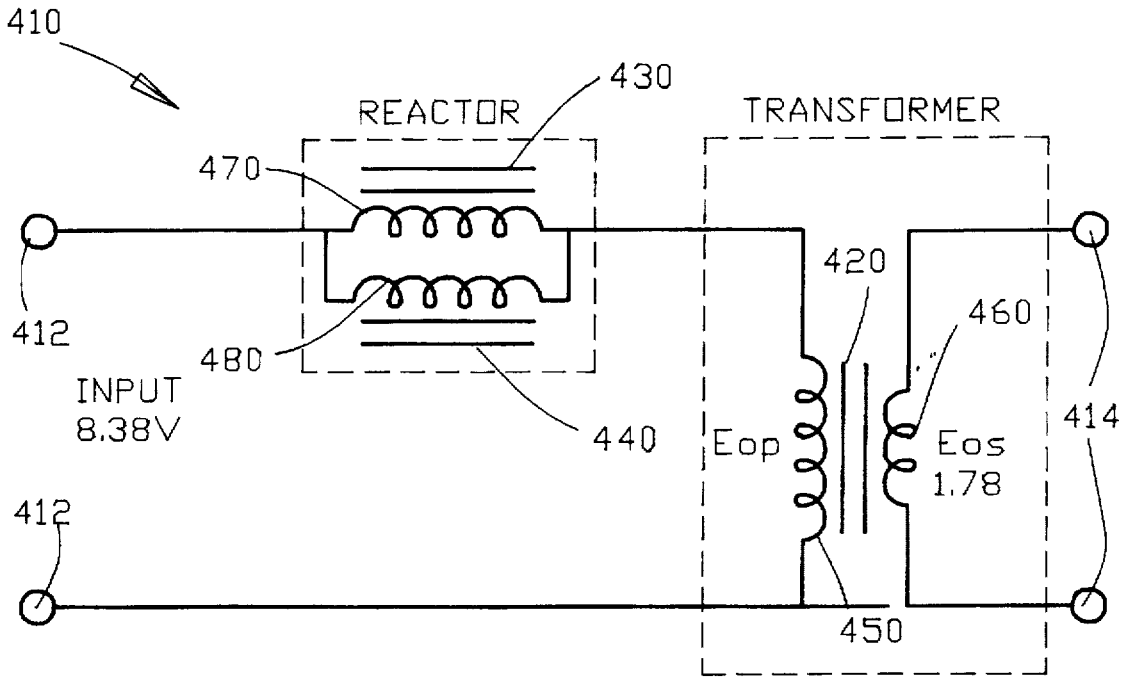
FIG. 16 is an equivalent circuit diagram of the circuit of FIG. 15.

FIG. 16 is an equivalent circuit diagram of the circuit of FIG. 15. The variable impedance transformer 410 is a current driven device and follows the law of equal ampere turns. The current supplied to the load 414 is linearly related to the current supplied to the first and second control windings 470 and 480. Accordingly, the current supplied to the load 414 varies directly with the ampere turns of the first and second control windings 470 and 480. In order to maintain a balanced condition, the ampere turns of the first and second control windings 470 and 480 must be equal to the ampere turns of the power output winding 460.

Figure 17:
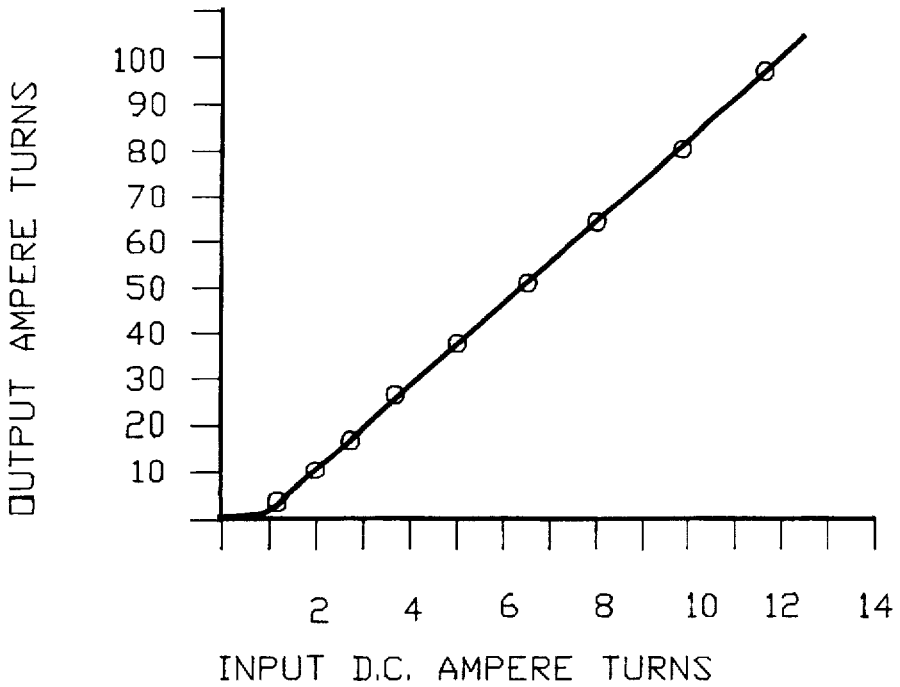
FIG. 17 is a graph of the ampere turns of the power output as a function of the DC ampere turns applied to control windings.

FIG. 17 is a graph of the ampere turns of the power output winding 460 as a function of the DC ampere turns applied to the first and second control winding 470 and 480. A balanced condition will hold true as long the variable impedance transformer 410 is operated in the linear portion of the magnetizing curve shown in FIG. 17. Therefore, the load current is determined by equation [1]:

$$I_L = K_1 * N_c * I_c / N_s \qquad [1]$$

where $I_L$ is the current in the load 414, $K_1$ is the primary to secondary transfer ratio, $N_c$ is the number of turns of the control windings, $I_c$ is the DC control current, and $N_s$ is the number of turns of the secondary winding.

Equation [1] demonstrates that the current $I_1$ in the load 414 is independent of the load resistance and constant current will be supplied even though there may be a bolted short. Equation [1] holds true as long as the law of equal ampere turns is applied, meaning that the variable impedance transformer 410 cannot supply a constant current if the secondary is open circuited or the load impedance lies outside the design parameters of the variable impedance transformer 410.

Figure 18:
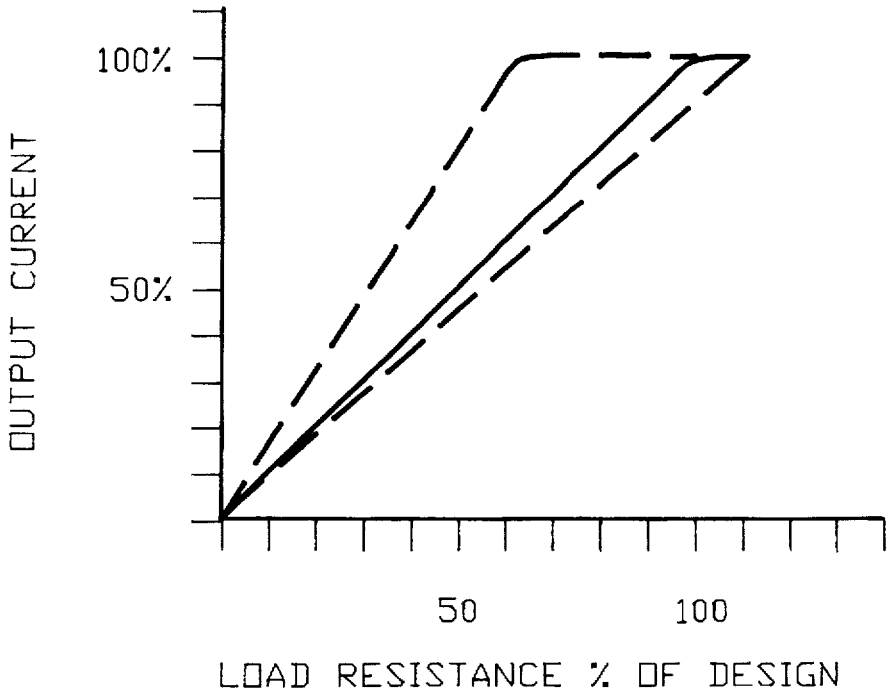
FIG. 18 is a graph of the current of the power output winding as a function of the load resistance percentage of design.

FIG. 18 is a graph of the current of the power output winding 460 as a function of the load resistance percentage of design. FIG. 18 illustrates the slope of the current changes with load impedance. The current slope is given by equation [2]:

$$\tan^{-1} 100/(R*K_2) \quad [2]$$

where

R is the load impedance (resistance) at 100% design

K2 is the constant by which the resistance is deviated from R in percent.

The amount of the power reduction is dependent upon construction parameters including winding turns and core construction between the power core 420 and the first and second saturable reactor cores 430 and 440. The reduction of power transferred through the power core 420 and the power output winding 460 to the load 414 compensates for the significantly higher surge current required during the start of the load 414.

If the power output winding 460 of the variable impedance transformer 410 is connected to a load 414 such as a furnace or lighting equipment or the like typically having a substantial operating current, the variable voltage tap 511 of the voltage reduction transformer 514 is positioned to supply a minimum DC voltage to the first and second control windings 470 and 480. When the alternating input power source 412 is activated, the high impedance provided by the first and second saturable reactor cores 430 and 440 limit the current from the power output winding 460 to the load 414.

In some design applications, the output voltage of the variable impedance transformer 410 applied to the load 414 is required to be reduced to less than one percent (1%) of the full load output voltage of the variable impedance transformer 410. In order to obtain this condition, the impedance in the power input winding 450 of the variable impedance transformer 410 needs to be 99 times higher than the combined impedance of the power output winding 460 and the impedance of the load 414.

The present invention provides an enhanced variable impedance transformer capable of reducing the output voltage of the enhanced variable impedance transformer to less than 1% of the full load output voltage.

Figure 19:
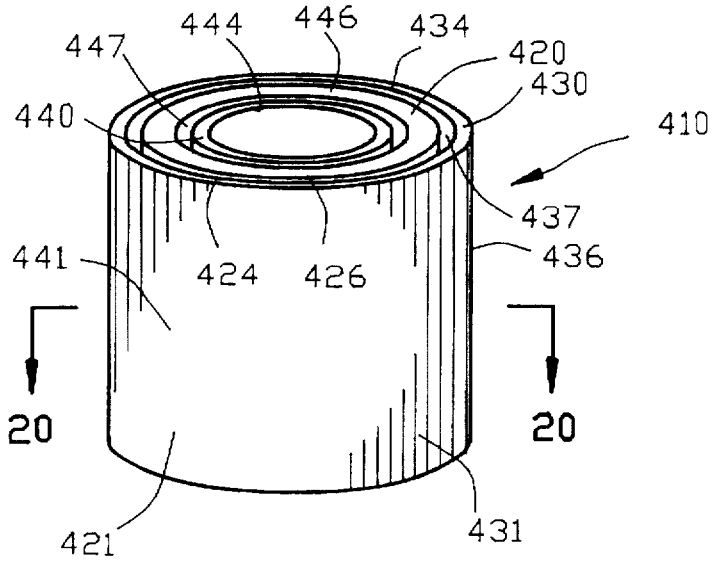
FIG. 19 is an isometric view of the variable impedance transformer incorporating the present invention.
Figure 20:
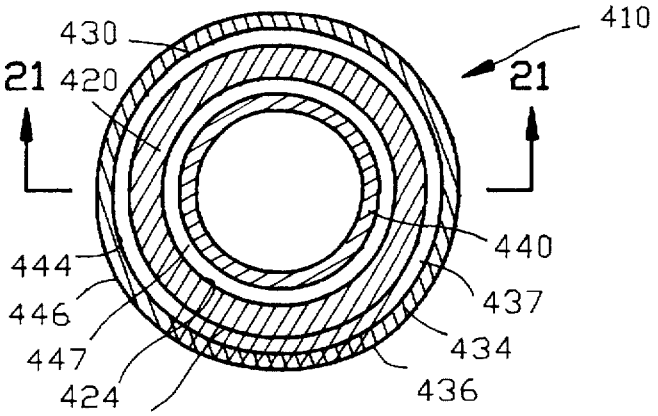
FIG. 20 is a sectional view along line 20—20 in FIG. 19.
Figure 21:
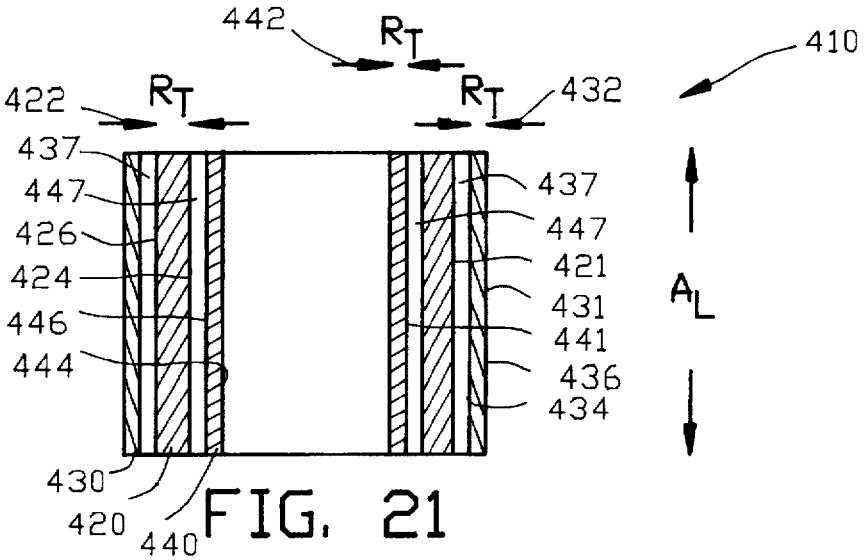
FIG. 21 is a sectional view along line 21—21 in FIG. 20.

FIG. 19 is an isometric view of the variable impedance transformer 410 incorporating the present invention. FIG. 20 is a sectional view along line 20—20 in FIG. 19 whereas FIG. 21 is a sectional view along line 21—21 in FIG. 20. The variable impedance transformer 410 comprises an annular power core 420 and a first and a second annular saturable reactor core 430 and 440. Each of the first and second saturable reactor cores 430 and 440 and the power core 420 are gapless to provide a continuous closed loop for the magnetic flux.

The power core 420 is defined by an axial length 421 shown by the dimension (AL) and a radial thickness 422 shown by the dimension (RT) and defined between an inner annular diameter 424 and an outer annular diameter 426. In a similar manner, the first saturable core reactor 430 is defined by an axial length 431 and a radial thickness 432 defined between an inner annular diameter 434 and an outer annular diameter 436. The second saturable core reactor 440 is defined by an axial length 441 and a radial thickness 442 defined between an inner annular diameter 444 and an outer annular diameter 446.

The axial length 421 of the power core 420 is equal to the axial lengths 431 and 441 of the first and second saturable reactor cores 430 and 440. The radial thickness 432 of the first saturable reactor core 430 is equal to the radial thicknesses 442 of the second saturable reactor core 440. Accordingly, the first and second saturable reactor cores 430 and 440 have a substantially identical cross-sectional area.

Preferably, the radial thickness 422 of the power core 420 is substantially equal to a sum of the radial thickness 431 of the first saturable reactor core 430 plus the radial thickness 441 of the second saturable reactor core 440. This configuration provides the power core 420 with a cross-sectional area substantially equal to a sum of the cross-sectional areas of the first and second saturable reactor cores 430 and 440.

The inner and outer annular diameters 424 and 426 of the power core 420 are established with the inner diameter 434 of the first saturable reactor core 430 and the outer diameter 446 of the second saturable reactor core 440 for enabling all of the cores 420, 430 and 440 to be disposed in a coaxial relationship with the annular power core 420 being interposed between the first and second annular saturable cores 430 and 440.

A space 437 is defined between the outer annular diameter 426 of the power core 420 and the inner diameter 434 of the first saturable reactor core 430. In a similar manner, a space 447 is defined between the inner diameter 424 of the power core 420 and the outer diameter 446 of the second saturable reactor core 440.

The size of the spaces 437 and 447 is determined by the size of the turns and the number of coils wound around the power core 420 and the first and second saturable cores 430 and 440. Preferably, all of the windings are wound for reducing the required spaces 437 and 447.

Figure 22:
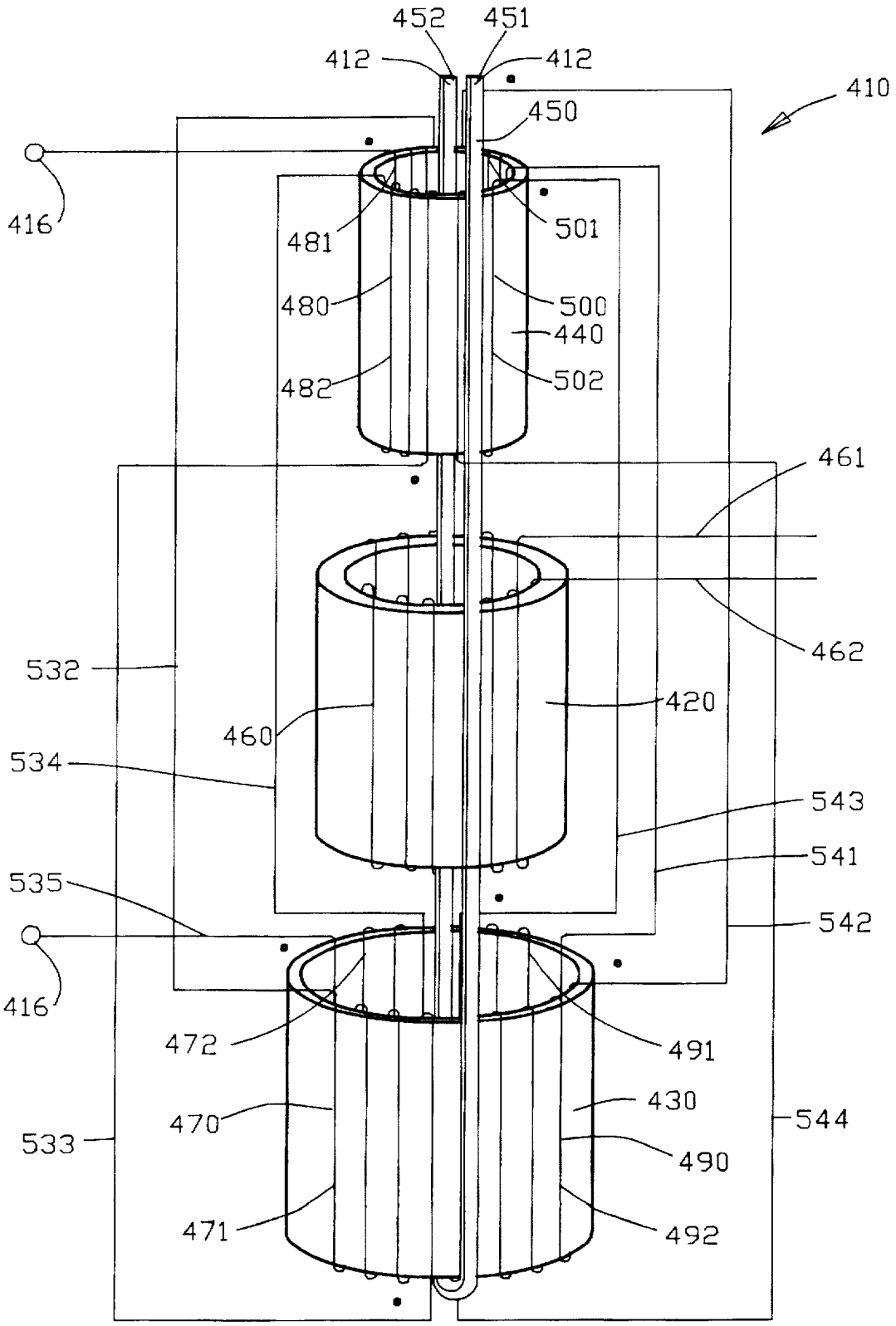
FIG. 22 is an exploded view of the variable impedance transformer of FIGS. 19–21.

FIG. 22 is an exploded view of the variable impedance transformer 410 of FIGS. 19–21 illustrating the power core 420 and the first and second saturable cores 430 and 440. The power input winding 450 is simultaneously wound about the power core 420 and wound about the first and second saturable cores 430 and 440. The first and second control windings 470 and 480 are respectively wound about the first and second annular saturable reactor cores 430 and 440. The power input winding 450 is wound for reducing the required spaces 437 and 447.

Figure 23:
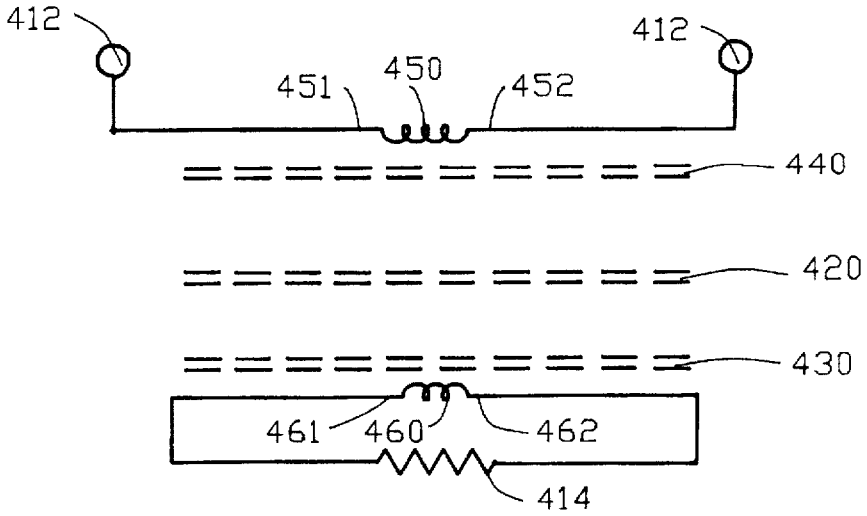
FIG. 23 is a circuit diagram of the power input winding and the power output winding of the variable impedance transformer of FIGS. 19–22.

FIG. 23 is a circuit diagram of the power input winding 450 and the power output winding 460 of the variable impedance transformer 410 of FIGS. 19–22. The power input winding 450 is simultaneously wound about the annular power core 420 and the first and second annular saturable reactor cores 430 and 440 when the power core 420 is interposed between the first and second saturable reactor cores 430 and 440. The magnetic flux induced by the power input winding 450 is distributed between and propagated in the same direction with the power core 420 and the first and the second saturable reactor core 430 and 440. The density of the magnetic flux induced by the power input winding 450 is directly proportional to the frequency of the alternating input power source 412, the number of turns of the power input winding 450, and the sum of the cross-sectional areas of the power core 420 and the first and the second saturable reactor core 430 and 440.

The power output winding 460 is wound solely about the annular power core 420 for transferring power to the load 414. Preferably, the power output winding 460 is wound for minimizing the spaces 437 and 447 between the power core 420 and the first and the second saturable reactor core 430 and 440.

Figure 24:
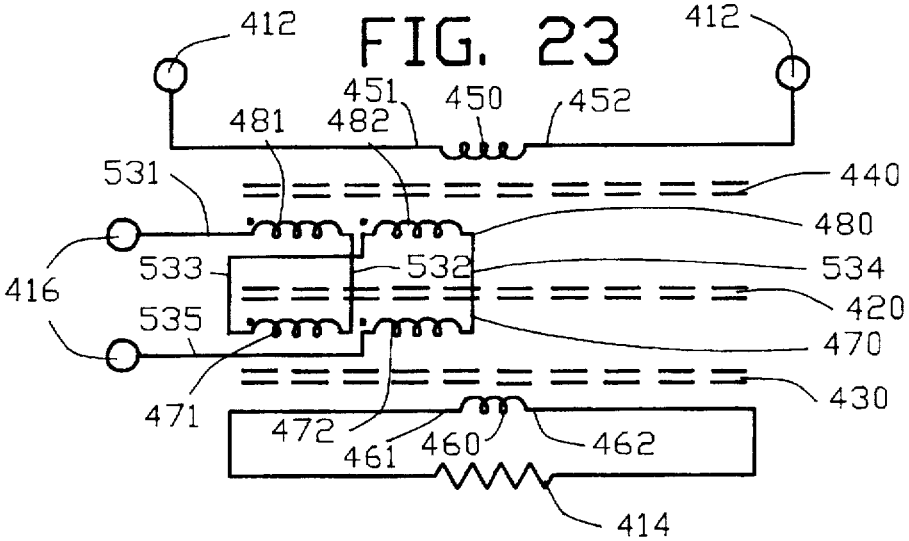
FIG. 24 is a circuit diagram of the control windings of the variable impedance transformer of FIGS. 19–22.

FIG. 24 is a circuit diagram of the first and second control windings 470 and 480 of the variable impedance transformer 410 of FIGS. 19–22. The first and second control windings 470 and 480 are respectively wound about the first and second annular saturable reactor cores 430 and 440 for controlling saturation of magnetic flux in the first and second annular saturable reactor cores 430 and 440. The first and second control windings 470 and 480 have a substantially identical number of winding turns and are connected in electrical opposition for substantially canceling a resultant magnetic flux induced by the first and second control windings 470 and 480.

In this embodiment, the first control winding 470 comprises plural control windings 471 and 472 wound on the first saturable reactor core 430. The second control winding 480 comprises plural control windings 481 and 482 wound on the second saturable reactor core 440. The plural first control windings 471 and 472 are connected in electrical opposition by connectors 531–535 to the plural second control windings 481 and 482 for substantially canceling a resultant magnetic flux induced by the first and second control windings 470 and 480.

Although each of the first and second control windings 470 and 480 have been shown to have two control windings, it should be understood that each of the first and second control windings 470 and 480 may have many more windings limited only by the spaces 437 and 447 and the cost of manufacture.

The control winding 481 of the second saturable reactor core 440 is cross connected by connectors 531–535 in series opposition with the control winding 471 of the first saturable reactor core 430 to form a first pair of control windings in opposition. Similarly, the control winding 482 of the second saturable reactor core 440 is cross connected by connectors 531–535 in series opposition with the control winding 472 of the first saturable reactor core 430 to form a second pair of control windings in opposition. In the event that more control windings are desired, the additional control windings are arranged and interconnected to form additional pairs of control windings in opposition for neutralizing the voltage across all of the control windings.

The first and second control windings 470 and 480 of the first and second saturable reactor cores 430 and 440 may be either wound or connected to provide a counterclockwise magnetic flux current in the first saturable reactor core 430 and to provide a clockwise magnetic flux current in the second saturable reactor core 440 in FIG. 22. Accordingly, the first control winding 470 is electrically connected in opposition to the second control winding 480 or the first control winding 470 is wound in opposition to the second control winding 480 to provide a counterclockwise and clockwise magnetic flux currents in the first and second saturable reactor core 430 and 440.

As should be well known to those skilled in the art, a substantial effort is made to construct the first and second saturable reactor cores 430 and 440 to be identical to one another in order to cancel resultant magnetic flux from the first and the second control windings 470 and 480. Unfortunately, it is difficult to construct the first and second saturable reactor cores 430 and 440 to be identical to one another. Accordingly, a resultant magnetic flux is generated by the first and the second control windings 470 and 480.

A major difference between the variable impedance transformer 410 of the present invention and the variable impedance transformer disclosed in U.S. Pat. No. 4,129,820 to E. Brock is in the manner in which a neutral balance is achieved in the first and second saturable cores 430 and 440. The control windings disclosed in the U.S. Pat. No. 4,129,820 to E. Brock are cross-connected to oppose the voltage induced in the respective control winding. In contrast, the first and second control windings 470 and 480 of the variable impedance transformer 410 of the present invention are cross-connected to cancel the flux currents within the first and second saturable reactor cores 430 and 440.

Figure 25:
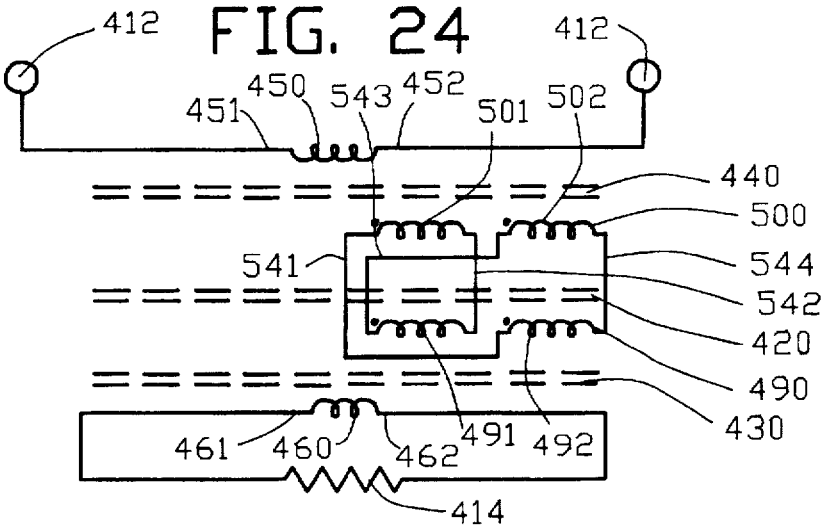
FIG. 25 is a circuit diagram of the equalizing windings of the variable impedance transformer of FIGS. 19–22.

FIG. 25 is a circuit diagram of the first and second control equalizing 490 and 500 of the variable impedance transformer 410 of FIGS. 19–22. To overcome the problem of the resultant magnetic flux generated by the first and the second control windings 470 and 480, the variable impedance transformer 410 of FIGS. 19–22 incorporates a low impedance equalizing winding means comprising a first and a second equalizing winding 490 and 500 for shunting any resultant alternating voltage induced by any residual magnetic flux as a result of non-substantial physical variations between the first and second annular saturable reactor cores 430 and 440.

The first and second equalizing winding 490 and 500 are respectively wound about the first and second annular saturable reactor cores 430 and 440 and have a substantially identical number of winding turns. The first and second equalizing winding 490 and 500 are connected in electrical opposition and are shorted for shunting any resultant alternating voltage induced within the first and second saturable reactor cores 430 and 440 by the first and second control windings 470 and 480.

In this embodiment, the first equalizing winding 490 comprises plural equalizing windings 491 and 492 wound on the first saturable reactor core 430. The second equalizing winding 500 comprises plural equalizing windings 501 and 502 wound on the second saturable reactor core 440. The plural first equalizing windings 491 and 492 are connected in electrical opposition by connectors 541–544 to the plural second equalizing windings 501 and 502 for shunting any resultant alternating voltage induced within the first and second saturable reactor cores 430 and 440 by the first and second control windings 470 and 480.

The equalizing winding 501 of the second saturable reactor core 440 is cross connected by connectors 541–544 in series opposition with the equalizing winding 491 of the first saturable reactor core 430 to form a first pair of equalizing windings in opposition. Similarly, the equalizing winding 502 of the second saturable reactor core 440 is cross connected by connectors 541–544 in series opposition with the equalizing winding 492 of the first saturable reactor core 430 to form a second pair of equalizing windings in opposition. In the event that more equalizing windings are desired, the additional equalizing windings are arranged and interconnected to form additional pairs of equalizing windings in opposition for shunting any resultant alternating voltage induced within the first and second saturable reactor cores 430 and 440.

The first and second equalizing windings 490 and 500 of the first and second saturable reactor cores 430 and 440 may be either wound or connected to provide a counterclockwise magnetic flux current in the first saturable reactor core 430 and to provide a clockwise magnetic flux current in the second saturable reactor core 440 in FIG. 22. Accordingly, the first equalizing winding 490 may be electrically connected in opposition to the second equalizing winding 500 or the first equalizing winding 490 may be wound in opposition to the second equalizing winding 500 to provide a counterclockwise and clockwise magnetic flux currents in the first and second saturable reactor core 430 and 440.

Preferably, each of the control windings 471, 472, 481 and 482 have an equal number of turns to produce the same amount of voltage across each of the respective control windings. In a similar manner, each of the first and second equalizing windings 491, 492, 501 and 502 have an equal number of turns to produce the same amount of voltage across each of the respective equalizing windings. Preferably, each of the first and second control windings 470 and 480 has a substantially equal number of turns than the equalizing winding 490 and 500.

Typically, the voltage generated in each of the control windings 471, 472, 481 and 482 and the first and second equalizing windings 491, 492, 501 and 502 and the power output winding 460 is equal to the number of turns of each of the respective windings divided by the number of turns of the power input winding 450 multiplied by the voltage applied to the power input winding 450. A full and complete discussion of the function and operation of the equalizing windings is set forth in my U.S. Pat. No. 5,163,173, issued on Nov. 10, 1992, the subject matter of which is incorporated into the present specification.

The variable impedance transformer 410 of the present invention is capable of reducing the output voltage on the power output windings 460 of the variable impedance transformer 410 to less than one percent (1%) of the full load output voltage. In order to obtain this reduction in the output voltage on the power output windings 460, the impedance in the power input winding 450 must be 99 times higher than the combined impedance of the power output winding 460 and the load 414.

Several provisions have been set forth herein for increasing the impedance of the variable impedance transformer 410 of the present invention. It should be understood by those skilled in the art that any increase in leakage flux reduces the impedance of the power input winding 450.

First, the variable impedance transformer 410 incorporates the first and second annular saturable cores 430 and 440 being disposed in a coaxial relationship with the annular power core 420 being interposed between the first and second annular saturable cores 430 and 440. This coaxial relationship of the annular power core 420 interposed between the first and second annular saturable cores 430 and 440 reduces the leakage flux of the variable impedance transformer. The spaces 437 and 447 are minimized resulting in the flux generated by the input power winding 450 being closely coupled to the power output winding 460 for reducing the leakage flux.

Secondly, the variable impedance transformer 410 incorporates the annular power core 420 and the first and second annular saturable cores 430 and 440 having equal axial lengths 421, 431 and 441.

Thirdly, the variable impedance transformer 410 incorporates the combined cross-sectional area of the first and second annular saturable cores 430 and 440 being at least equal to the cross-sectional area of the annular power core 420. The impedance of the power input winding 450 can be further increased by making combined cross-sectional area of the first and second annular saturable cores 430 and 440 greater than the cross-sectional area of the annular power core 420.

Fourthly, the power input winding is wound equally around the cores of the first and second annular saturable cores 430 and 440 and the annular power core 420.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A variable impedance transformer for controlling the power from an alternating input power source to a load in accordance with a direct current control signal, comprising:

a first and a second annular saturable reactor core;

an annular power core;

a power input winding being simultaneously wound about said annular power core and said first and second annular saturable reactor cores;

a power output winding being wound about said annular power core for transferring power to the load;

means connecting said power input windings to the alternating input power source for establishing a magnetic flux in said annular power core and in said first and second annular saturable reactor cores;

a first and a second control winding respectively wound about said first and second annular saturable reactor cores for controlling saturation of magnetic flux in said first and second annular saturable reactor cores in accordance with the direct current control signal;

said direct current control signal controlling saturation of magnetic flux in said first and second annular saturable reactor cores thereby controlling the power transferred from the power input winding through said annular power core to said power output;

said first and second annular saturable cores being disposed in a coaxial relationship with said annular power core being interposed between said first and second annular saturable cores for reducing leakage flux of the variable impedance transformer.

2. A variable impedance transformer as set forth in claim 1, wherein each of said first and second saturable reactor cores and said power core provides a closed loop for said magnetic flux.

3. A variable impedance transformer as set forth in claim 1, wherein said first and second saturable reactor cores have a substantially identical cross-sectional area.

4. A variable impedance transformer as set forth in claim 1, wherein said first and second saturable reactor cores have a substantially identical cross-sectional area; and said power core having a cross-sectional area substantially equal to a sum of said cross-sectional areas of said first and second saturable reactor cores.

5. A variable impedance transformer as set forth in claim 1, wherein each of said first and second saturable reactor cores and said power core is defined by an axial length and a radial thickness defined between an inner and an outer annular diameter;

said axial length of said power core being equal to said axial lengths of said first and second saturable reactor cores.

6. A variable impedance transformer as set forth in claim 1, wherein each of said first and second saturable reactor cores and said power core is defined by an axial length and a radial thickness defined between an inner and an outer annular diameter; and said radial thicknesses of said first and second saturable reactor cores and said power core being established for enabling said first and second annular cores to be disposed in a coaxial relationship with said annular power core being interposed between said first and second annular saturable cores.

7. A variable impedance transformer as set forth in claim 1, wherein each of said first and second saturable reactor cores and said power core is defined by an axial length and a radial thickness defined between an inner and an outer annular diameter; and said axial length of said power core being equal to said axial lengths of said first and second saturable reactor cores; and said radial thickness of said power core being substantially equal to a sum of the radial thicknesses of said first and second saturable reactor cores establishing said power core to have a cross-sectional area substantially equal to a sum of said cross-sectional areas of said first and second saturable reactor cores.

8. A variable impedance transformer as set forth in claim 1, wherein said power input winding is simultaneously wound about said first saturable reactor core and said power core and said second saturable reactor core.

9. A variable impedance transformer as set forth in claim 1, wherein said power input winding is simultaneously wound about said first saturable reactor core and said power core and said second saturable reactor core; and said power input winding being simultaneously wound with said annular power core being interposed between said first and second annular saturable cores.

10. A variable impedance transformer as set forth in claim 1, wherein said power input winding is simultaneously wound about said first and second saturable reactor cores and said power core with an induced magnetic flux being distributed between said first and said second saturable reactor core and said power core.

11. A variable impedance transformer as set forth in claim 1, wherein said power input winding is simultaneously wound about said first and second saturable reactor cores and said power core for enabling the alternating input power source to establish a magnetic flux in said first and said second saturable reactor cores propagating in the same direction.

12. A variable impedance transformer as set forth in claim 1, wherein said power output winding means is wound solely about said power core.

13. A variable impedance transformer as set forth in claim 1, wherein said first and second saturable reactor cores have substantially identical cross-sectional areas;

said first and second control windings having a substantially identical number of winding turns; and said first and second control windings being interconnected in electrical opposition for substantially canceling a resultant magnetic flux induced by said first and second control windings.

14. A variable impedance transformer as set forth in claim 1, wherein said first control winding comprises plural control windings wound on said first saturable reactor core and connected in electrical series;

said second control winding comprises plural control windings wound on said second saturable reactor core and connected in electrical series; and said plural first control windings being connected in electrical opposition to said plural second control windings for substantially canceling a resultant magnetic flux induced by said first and second control windings.

15. A variable impedance transformer for controlling the power from an alternating input power source to a load in accordance with a direct current control signal, comprising:

a first and a second annular saturable reactor core;

an annular power core;

a power input winding being simultaneously wound about said annular power core and said first and second annular saturable reactor cores;

a power output winding being wound about said annular power core for transferring power to the load;

means connecting said power input windings to the alternating input power source for establishing a magnetic flux in said annular power core and in said first and second annular saturable reactor cores;

a first and a second control winding respectively wound about said first and second annular saturable reactor cores for controlling saturation of magnetic flux in said first and second annular saturable reactor cores in accordance with the direct current control signal;

said direct current control signal controlling saturation of magnetic flux in said first and second annular saturable reactor cores thereby controlling the power transferred from the power input winding through said annular power core to said power output;

said first and second annular saturable cores being disposed in a coaxial relationship with said annular power core being interposed between said first and second annular saturable cores for reducing leakage flux of the variable impedance transformer; and a low impedance equalizing winding being wound about said first and second annular saturable reactor cores for shunting any resultant alternating voltage induced by any residual magnetic flux as a result of non-substantial physical variations between said first and second annular saturable reactor cores.

16. A variable impedance transformer as set forth in claim 15, wherein each of said first and second saturable reactor cores and said power core provides a closed loop for said magnetic flux.

17. A variable impedance transformer as set forth in claim 15, wherein said first and second saturable reactor cores have a substantially identical cross-sectional area.

18. A variable impedance transformer as set forth in claim 15, wherein said first and second saturable reactor cores have a substantially identical cross-sectional area; and said power core having a cross-sectional area substantially equal to a sum of said cross-sectional areas of said first and second saturable reactor cores.

19. A variable impedance transformer as set forth in claim 15, wherein each of said first and second saturable reactor cores and said power core are defined by an axial length and a radial thickness defined between an inner and an outer annular diameter;

said axial length of said power core being equal to said axial lengths of said first and second saturable reactor cores.

20. A variable impedance transformer as set forth in claim 15, wherein each of said first and second saturable reactor cores and said power core are defined by an axial length and a radial thickness defined between an inner and an outer annular diameter; and said radial thicknesses of said first and second saturable reactor cores and said power core being established for enabling said first and second annular cores to be disposed in a coaxial relationship with said annular power core being interposed between said first and second annular saturable cores.

21. A variable impedance transformer as set forth in claim 15, wherein each of said first and second saturable reactor cores and said power core are defined by an axial length and a radial thickness defined between an inner and an outer annular diameter; and said axial length of said power core being equal to said axial lengths of said first and second saturable reactor cores; and said radial thickness of said power core being substantially equal to a sum of the radial thicknesses of said first and second saturable reactor cores establishing said power core to have a cross-sectional area substantially equal to a sum of said cross-sectional areas of said first and second saturable reactor cores.

22. A variable impedance transformer as set forth in claim 15, wherein said power input winding is simultaneously wound about said first saturable reactor core and said power core and said second saturable reactor core.

23. A variable impedance transformer as set forth in claim 15, wherein said power input winding is simultaneously wound about said first saturable reactor core and said power core and said second saturable reactor core; and said power input winding being simultaneously wound with said annular power core being interposed between said first and second annular saturable cores.

24. A variable impedance transformer as set forth in claim 15, wherein said power input winding is simultaneously wound about said first and second saturable reactor cores and said power core with an induced magnetic flux being distributed between said first and said second saturable reactor core and said power core.

25. A variable impedance transformer as set forth in claim 15, wherein said power input winding is simultaneously wound about said first and second saturable reactor cores and said power core for enabling the alternating input power source to establish a magnetic flux in said first and said second saturable reactor cores propagating in the same direction.

26. A variable impedance transformer as set forth in claim 15, wherein said power output winding means is wound solely about said power core.

27. A variable impedance transformer as set forth in claim 15, wherein said first and second saturable reactor cores have substantially identical cross-sectional areas;

said first and second control windings having a substantially identical number of winding turns; and said first and second control windings being interconnected in electrical opposition for substantially canceling a resultant magnetic flux induced by said first and second control windings.

28. A variable impedance transformer as set forth in claim 15, wherein said first control winding comprises plural control windings wound on said first saturable reactor core and connected in electrical series;

said second control winding comprises plural control windings wound on said second saturable reactor core and connected in electrical series; and said plural first control windings being connected in electrical opposition to said plural second control windings for substantially canceling a resultant magnetic flux induced by said first and second control windings.

29. A variable impedance transformer as set forth in claim 15, wherein said equalizing winding is connected to a low impedance for shunting any resultant alternating voltage induced within said first and second saturable reactor cores by said first and second control windings.

30. A variable impedance transformer as set forth in claim 15, wherein said equalizing winding is shorted for shunting any resultant alternating voltage induced within said first and second saturable reactor cores by said first and second control windings.

31. A variable impedance transformer as set forth in claim 15, wherein each of said first and second control windings has a substantially identical number of turns than said equalizing winding.

32. A variable impedance transformer as set forth in claim 15, wherein said equalizing winding comprises a first and a second equalizing winding; and said first and second equalizing windings being wound about said first and second saturable reactor cores, respectively; and said first and second equalizing windings being interconnected in electrical opposition.

* * * * *